US009192208B2

(12) United States Patent
Peikert et al.

(10) Patent No.: US 9,192,208 B2
(45) Date of Patent: Nov. 24, 2015

(54) ITEM OF FOOTWEAR WITH VENTILATION IN THE BOTTOM REGION OF THE SHAFT, AND AIR-PERMEABLE SPACER STRUCTURE WHICH CAN BE USED FOR THIS PURPOSE

(76) Inventors: Marc Peikert, Bad Tolz (DE); Ambrosius Bauer, Warngau (DE); Christian Bier, Miesbach (DE); Andrea Giupponi, Verona (IT)

( * ) Notice: Subject to any disclaimer, the term of this patent is extended or adjusted under 35 U.S.C. 154(b) by 759 days.

(21) Appl. No.: 12/996,788

(22) PCT Filed: Jun. 8, 2009

(86) PCT No.: PCT/EP2009/004108

§ 371 (c)(1),
(2), (4) Date: Feb. 10, 2011

(87) PCT Pub. No.: WO2009/149886

PCT Pub. Date: Dec. 17, 2009

(65) Prior Publication Data

US 2011/0167677 A1 Jul. 14, 2011

(30) Foreign Application Priority Data

Jun. 11, 2008 (DE) ..... 10 2008 027 856

(51) Int. Cl.
*A43B 7/06* (2006.01)
*A43B 7/08* (2006.01)
(Continued)

(52) U.S. Cl.
CPC ... *A43B 7/06* (2013.01); *A43B 1/04* (2013.01); *A43B 7/08* (2013.01); *A43B 7/082* (2013.01); *A43B 7/084* (2013.01); *A43B 7/125* (2013.01); *A43B 13/38* (2013.01)

(58) Field of Classification Search
CPC ..... A43B 7/06; A43B 7/08; A43B 7/082; A43B 7/084; A43B 7/085; A43B 7/088
USPC ..... 36/3 R, 3 A, 3 B
See application file for complete search history.

(56) References Cited

U.S. PATENT DOCUMENTS 1,390,929 A * 9/1921 Saudino ..... 36/3 R
2,022,488 A * 11/1935 Calderazzo ..... 36/45
(Continued)

FOREIGN PATENT DOCUMENTS

CN 2896955 5/2007
DE 1034067 7/1958
(Continued)

*Primary Examiner* — Marie Bays
(74) *Attorney, Agent, or Firm* — Carol A. Lewis White

(57) ABSTRACT

Item of footwear (100) having an upper arrangement (112) and a sole (114), wherein the upper arrangement (112) has a top material (116) and an air-permeable layer (140) arranged in a base of the upper, the air-permeable layer (140) is arranged above the sole (114), in a sole-side, bottom region of the upper arrangement (112), the air-permeable layer (140) has a three-dimensional structure allowing the through-passage of air in at least the horizontal direction, and a sole-side, bottom peripheral region of the top material (116) of the upper is replaced, over at least part of its peripheral extent, by at least one connecting material (210) which, beginning at least above an underside of the air-permeable layer (140) and running outside the air-permeable layer (140), is arranged on the base of the upper and is air-permeable at least in a sub-region located at least in part at the same level as the air-permeable layer (140), and thus connects the air-permeable layer (140) to the exterior surroundings such that air can be exchanged between the exterior surroundings and the air-permeable layer (140).

14 Claims, 17 Drawing Sheets

(51) Int. Cl.

| | |
|---|---|
| ***A43B 1/04*** | (2006.01) |
| ***A43B 7/12*** | (2006.01) |
| ***A43B 13/38*** | (2006.01) |

(56) References Cited

U.S. PATENT DOCUMENTS

| | | | | | |
|---|---|---|---|---|---|
| 2,098,412 | A | * | 11/1937 | Bovay | 36/3 R |
| 3,012,342 | A | * | 12/1961 | Ramirez | 36/3 B |
| 3,952,358 | A | | 4/1976 | Fukuoka | |
| 3,953,566 | A | | 4/1976 | Gore | |
| 4,034,431 | A | | 7/1977 | Fukuoka | |
| 4,078,321 | A | * | 3/1978 | Famolare, Jr. | 36/3 B |
| 4,187,390 | A | | 2/1980 | Gore | |
| 4,194,041 | A | | 3/1980 | Gore et al. | |
| 4,493,870 | A | | 1/1985 | Vrouenraets et al. | |
| 4,725,418 | A | | 2/1988 | Friemel et al. | |
| 4,835,883 | A | | 6/1989 | Tetrault et al. | |
| 4,837,948 | A | * | 6/1989 | Cho | 36/3 A |
| 4,910,887 | A | * | 3/1990 | Turner et al. | 36/114 |
| 5,329,807 | A | | 7/1994 | Sugar et al. | |
| 5,746,013 | A | | 5/1998 | Fay, Sr. | |
| 6,477,789 | B2 | | 11/2002 | Cheng | |
| 6,477,792 | B2 | | 11/2002 | Sartor | |
| 6,508,015 | B1 | | 1/2003 | Rauch | |
| 6,655,048 | B2 | * | 12/2003 | Moretti | 36/3 R |
| 6,681,500 | B2 | | 1/2004 | Moretti | |
| 6,889,711 | B2 | | 5/2005 | Vetoretti et al. | |
| 6,948,260 | B2 | | 9/2005 | Lin et al. | |
| 7,367,141 | B2 | | 5/2008 | Polegato Moretti | |
| 7,610,694 | B2 | | 11/2009 | DeGiacomi | |
| 7,716,851 | B2 | | 5/2010 | Polegato Moretti | |
| 8,205,354 | B2 | | 6/2012 | Polegato Moretti | |
| 8,276,294 | B2 | | 10/2012 | Polegato Moretti | |
| 8,312,644 | B2 | | 11/2012 | Peikert et al. | |
| 8,356,425 | B2 | | 1/2013 | Polegato Moretti | |
| 2004/0049942 | A1 | | 3/2004 | Chen | |
| 2005/0126036 | A1 | | 6/2005 | Wu | |
| 2006/0099431 | A1 | | 5/2006 | Scholz | |
| 2006/0137216 | A1 | * | 6/2006 | Ahlbaumer | 36/3 B |
| 2006/0162183 | A1 | | 7/2006 | Polegato Moretti | |
| 2007/0011907 | A1 | * | 1/2007 | Polegato Moretti | 36/3 B |
| 2007/0271815 | A1 | | 11/2007 | Moretti et al. | |
| 2008/0209769 | A1 | | 9/2008 | Polegato Moretti | |
| 2009/0193690 | A1 | | 8/2009 | Moretti | |
| 2009/0211119 | A1 | | 8/2009 | Moretti | |
| 2009/0277047 | A1 | | 11/2009 | Polegato Moretti | |
| 2009/0300942 | A1 | | 12/2009 | Peikert | |
| 2010/0011624 | A1 | | 1/2010 | Polegato Moretti | |
| 2010/0050480 | A1 | | 3/2010 | Polegato Moretti | |
| 2011/0162239 | A1 | * | 7/2011 | Bier et al. | 36/3 B |
| 2011/0162240 | A1 | * | 7/2011 | Pieri | 36/3 B |
| 2011/0167678 | A1 | | 7/2011 | Peikert | |

FOREIGN PATENT DOCUMENTS

| | | |
|---|---|---|
| EP | 0 275 644 | 11/1987 |
| EP | 0 382 904 | 11/1989 |
| EP | 0 479 183 | 9/1991 |
| JP | 63-75205 | 6/1992 |
| WO | 90/04772 | 5/1990 |
| WO | 99/26504 | 6/1999 |
| WO | 99/66812 | 12/1999 |
| WO | 2004/028284 | 4/2004 |
| WO | 2006/010578 | 2/2006 |
| WO | 2006/056398 | 6/2006 |
| WO | 2007/101624 | 9/2007 |
| WO | 2007101625 | 9/2007 |
| WO | 2007/147421 | 12/2007 |
| WO | 2008/003375 | 1/2008 |
| WO | 2009149886 | 12/2009 |

* cited by examiner

ITEM OF FOOTWEAR WITH VENTILATION IN THE BOTTOM REGION OF THE SHAFT, AND AIR-PERMEABLE SPACER STRUCTURE WHICH CAN BE USED FOR THIS PURPOSE

The invention pertains to shoes with ventilation beneath the foot sole and with the removal of sweat moisture through layers beneath the foot to improve the climate comfort of such shoes.

In earlier times, shoes had either a certain water vapor permeability in the sole area, also called breathability, as a result of the use of a shoe sole material such as leather, with the drawback of water permeability in the sole area, or shoes were waterproof in the sole area, but were also water vapor impermeable in the sole area as a result of the use of outsoles made of a waterproof material, such as rubber or a rubber-like plastic, with the drawback that sweat moisture could accumulate in the foot sole area.

In more recent times, shoes that are waterproof and also water vapor-permeable in the foot sole area have been created by perforating their outsoles with through-holes and covering the through-holes with a waterproof, water vapor-permeable membrane arranged on the inside of the outsole, so that no water can penetrate into the shoe interior from the outside, but sweat moisture that forms in the foot sole area can escape outward from the shoe interior. Two different solutions have been pursued here. Either the outsole has been provided with vertical through-holes that pass through its thickness, through which sweat moisture can be guided from the shoe interior to the walking surface of the outsole, or the outsole has been provided with horizontal channels through which sweat moisture that has accumulated above the outsole can escape through the side periphery of the outsole.

Examples of the first solution, in which the outsole has vertical through-openings that pass through its thickness, are shown in EP 0 382 904 A1, EP 0 275 644 A1, and DE 20 2007 000 667 UM. A sole composite according to EP 0 382 904 A1 has a lower sole part equipped with microperforations, an upper sole part, also equipped with perforations, and a waterproof, water vapor-permeable membrane between these. The outsole in shoes according to EP 0 275 644 A1 is provided with relatively large-area vertical through-holes in order to acquire higher water vapor permeability, and a water vapor-permeable protective layer is arranged between it and the outsole for mechanical protection of the membrane. The outsole in shoes according to DE 20 2007 000 667 UM is provided with relatively large-area vertical through-holes in order to acquire greater water vapor permeability, which holes are closed with a water vapor-permeable protective layer. This type of outsole is attached to a waterproof shaft arrangement, so that a waterproof shoe is present.

Examples of the second solution, in which the outsole has horizontal ventilation channels running parallel to its walking surface, are known from EP 0 479 183 B1, EP 1 089 642 B1, EP 1 033 924 B1, and JP 16-75205 U.

The outsole in a shoe according to EP 0 479 183 B1 is provided on its side that faces away from the walking surface with a protruding outsole edge on its outer periphery, which is penetrated with microperforations which extend horizontally, i.e., parallel to the walking surface. In the space formed within the outsole edge, a spacer element with transverse webs protruding from the outsole is arranged, which can be embodied as a single piece with the outsole. An inner band belonging to the spacer element, which is also penetrated by horizontally running through-holes, is situated within the outsole edge and spaced from it. A water vapor-permeable inlay sole or insole is situated above the spacer element, wherein beneath the outer peripheral area of said insole, a last insert of a shaft consisting of water vapor-permeable material is inserted, which is situated on the inside of the inner band of the spacer element. A waterproof, water vapor-permeable membrane, extending upward roughly perpendicular from the inside of the outsole, is situated between the outsole edge with the horizontal microperforations and the inner band with the horizontal through-holes. Because of this membrane, on the one hand, water is prevented from penetrating between the webs and into the shoe interior, but on the other hand, sweat moisture that has reached between the webs from the shoe interior can theoretically reach the outside of the sole structure. However, the sweat moisture must then penetrate not only the membrane but also the microperforations of the outsole edge, the through-holes of the inner band, and the shaft material.

In the case of EP 1 089 642 B1 the outsole is provided on its side that faces away from the walking surface with an upper edge web on the outer periphery, in the top of which ventilation channels that pass through the edge web are made, and with hemispherical protrusions in a sole area within the edge web. An upper sole element is arranged on the top of the outsole, which upper sole element lies on the edge web and on the protrusions of the outsole and has a water vapor-permeable area covered with a waterproof, water vapor-permeable membrane, with an extension roughly equal to that of the area of the outsole that is provided with the protrusions. Sweat moisture that collects in the space between the outsole and the sole element in which the protrusions of the outsole are situated can theoretically escape through the ventilation channels in the edge web of the outsole.

EP 1 033 924 B1 shows a shoe with an outsole having an outer peripheral edge protruding from an inside of the outsole, which edge is perforated by horizontal ventilation channels, i.e., channels running parallel to the walking surface of the outsole. The outsole is attached to a shaft, which has a lower shaft area on the sole side, which area has a last insert connected to the bottom of a peripheral area of a perforated inlay sole. A waterproof, water vapor-permeable membrane is arranged in the space formed within the last insert on the bottom of the inlay sole. An air-permeable material constructed with fibers, for example from felt, is situated in the outsole space formed within the protruding outer peripheral edge. Sweat moisture that has reached the air-permeable material through the perforated inlay sole and the membrane can diffuse into the outer environment through the horizontal ventilation channels of the outer peripheral edge of the outsole. Water that has reached the air-permeable material through the ventilation channels, however, is prevented by the membrane from reaching the shoe interior through the inlay sole. A nail protection plate is situated on the inside of the outsole, so that the shoe is suitable as a safety shoe.

A shoe in which the two above-mentioned solutions are combined is known from JP 16-75205 U. The sole structure of this shoe has a perforated inlay sole, an outsole, which is provided on its upper side that faces the shoe interior with horizontally running grooves that open to the outside of the outsole periphery, and through-holes that extend from these grooves to the walking surface, and has a waterproof, water vapor-permeable membrane arranged on the bottom of the inlay sole, and a protective layer, for example made of felt, arranged between the membrane and the outsole. A lower end area of a shaft on the sole side is inserted in the form of a last insert on the bottom of a peripheral edge area of the inlay sole. While the membrane has the same area as the inlay sole, the protective layer is situated in the same plane as the last insert and the protective layer extends only between the inside edge of the last insert. The horizontally running grooves are open to the outer environment on the peripheral area of the outsole. Sweat moisture can therefore diffuse from the shoe interior through both the vertical through-holes to the outside of the walking surface of the outsole and through the horizontal grooves to the outer peripheral side.

Especially in shoes whose outsole is not provided with vertical through-holes penetrating its thickness or, for safety reasons, for example, cannot be provided with such through-holes because of the requirement of a nail protection plate, but even in shoes whose outsole is provided with such vertical through-holes, it is desirable to create a ventilation system in an area beneath the foot sole with which a noticeable increase in climate comfort in the foot sole area can be achieved.

From these standpoints a shoe was created by means of the invention disclosed in German Patent Application DE 10 2008 027 856 of the applicant, which has a ventilation space beneath the foot sole defined by an air-permeable spacer structure, which permits an efficient transport of sweat moisture (water vapor) that has reached beneath the foot through the layers.

This shoe has a shaft arrangement and a sole, the shaft arrangement having an outer shaft material and an air-permeable layer arranged in a shaft bottom. The air-permeable layer is arranged in a lower area of the shaft arrangement on the sole side, above the sole. The air-permeable layer has a three-dimensional structure that permits air passage in at least the horizontal direction. The outer shaft material has at least one air passage opening in a lower peripheral area on the sole side, by means of which a connection can be produced between the air-permeable layer and the outer environment of the shoe, such that air exchange between the outer environment and the air-permeable layer can occur. In this way, heat and water vapor can be removed from the area of the shaft arrangement situated above the air-permeable layer, for example, by means of convective air exchange through the air-permeable layer.

Since the at least one air passage opening in this solution, which permits the efficient removal of sweat moisture in conjunction with the air-permeable layer, is not formed in the outsole, where it cannot be particularly large from the standpoint of outsole stability and, especially in a shoe with a rather thin outsole, for aesthetic reasons, but in a lower peripheral area of the outer shaft material on the sole side, where the air passage opening can be made comparatively large without a problem, a situation is already achieved for better air exchange and therefore a greater water vapor removal capability than in a shoe whose at least one air passage opening is formed in the outsole.

Such a shaft arrangement with the air-permeable layer has the additional advantage that the air-permeable layer positioned between the at least one air passage opening and the shoe interior can extend directly to the inside of the shaft outer material and is not limited, as in the known solutions according to EP 1 033 924 B1 and JP 16-75205 U, to the interior space between the last insert edge of the outer shaft material. For example, in glue-lasted shoes, the air-permeable layer is situated above the glue-lasted insert and can therefore provide a larger exchange surface for water vapor and heat of the foot sole. The air-permeable layer in this solution can therefore have a significantly larger surface area than in the known solutions, with a correspondingly larger exchange surface and therefore water vapor removal capacity.

The high water vapor passage and air exchange effect achieved with it are advantageous both in shoes that need not be waterproof because they are only used in dry areas, for example, work shoes in an assembly plant, and in shoes that are also worn outdoors and may therefore be exposed to wetness.

For the latter case, a variant of this solution is used in which, at least in a lower area of the shaft arrangement that faces the sole, an at least water vapor-permeable functional layer is provided, the air-permeable layer being arranged beneath the functional layer. In one variant of this solution, the air-permeable layer is situated directly beneath the water vapor-permeable functional layer. In one variant of this solution, the functional layer is waterproof and water vapor-permeable.

In one variant of this solution both a shaft functional layer and a shaft bottom functional layer are provided, so that water vapor permeability with simultaneous water-tightness is achieved, both for the shaft and for the shaft bottom area of the shoe.

In another variant of this solution a waterproof and water vapor-permeable functional layer is situated in the shaft bottom area, for example, in the form of a functional layer laminate, wherein the air-permeable layer is situated directly beneath the functional layer or the functional layer laminate. In conjunction with this variant, one advantage of this solution lies especially in the fact that through the at least one air passage opening, in cooperation with the air-permeable layer, an air exchange and therefore a removal of sweat moisture and heat are made possible. The diffusion path that limits efficiency, which water vapor must initially traverse from the bottom of the foot to the air-permeable layer, is minimized by choosing the thinnest possible layer structure, which includes the functional layer, between the foot and air-permeable layer, so that the transfer of heat is maximized. If water vapor has reached the air-permeable layer, it is additionally transported away convectively by the air flow, so that the water vapor partial pressure difference between the two sides of the functional layer is permanently kept at a high level. No additional layers need be overcome. The water vapor partial pressure difference between the two sides of the functional layer is a driving force for the efficient removal of sweat moisture. In addition to water vapor, heat is also taken off by convection. Due to the fact that the air-permeable layer in the case of a lasted shaft is arranged above the last insert of the outer shoe material, roughly the entire sole surface is available for water vapor exchange.

In one variant of this solution with a shaft functional layer and a shaft bottom functional layer, these are part of a sock-like functional layer bootie, in which a shaft area is formed by the shaft functional layer and a sole area is formed by the shaft bottom functional layer.

In another variant of this solution with a shaft functional layer and a shaft bottom functional layer, the shaft functional layer and the shaft bottom functional layer are connected to each other at a lower shaft area and are sealed waterproof with respect to each other at their shared boundary.

In one variant of this solution the functional layer of the shaft functional layer and/or the shaft bottom functional layer is part of a multilayer laminate that has at least one textile layer in addition to the functional layer. Frequently used laminates are two-, three- or four-layered, with a textile layer on one side or a textile layer on both sides of the functional layer.

In one variant of this solution a shaft bottom functional layer laminate and/or a shaft functional layer laminate are constructed with the laminate.

In one variant of this solution the functional layer has a water vapor-permeable membrane. The membrane is preferably waterproof and water vapor-permeable. In a preferred variant, the functional layer has a membrane constructed with expanded microporous polytetrafluoroethylene (ePTFE).

In one variant of this solution the air-permeable layer is situated beneath the shaft bottom functional layer.

In one variant of this solution the air-permeable layer is situated directly beneath the shaft bottom functional layer, which, for the case in which the shaft bottom functional layer is part of a functional layer laminate, will mean that the air-permeable layer is situated directly beneath the functional layer laminate.

In one variant of this solution at least one air passage opening is arranged in the outer shaft material, such that it is situated at least partially at the same height as the air-permeable layer.

In one variant of this solution at least two at least roughly opposite air passage openings are arranged in the lower area of the outer shaft material in the transverse direction of the foot or the longitudinal direction of the foot. Convective air exchange is also made possible or promoted by this. Air exchange is strongly promoted by the relative movement of the shoe wearer with respect to the outside air. Air exchange is intensified in wind and/or during walking or running.

In another variant of this solution the lower peripheral area of the outer shaft material has several air passage openings arranged along the periphery of the shaft arrangement.

In one variant of this solution the lower end of the outer shaft material has a separate air-permeable shaft material, which is attached to the outer shaft material and is therefore part of the outer shaft material. This air-permeable shaft material, which extends around the majority of the shaft periphery or even around the entire shaft periphery, has a plurality of air passage openings due to its air-permeable structure. In one variant, the air-permeable shaft material is attached in the form of a mesh to the lower end of the outer shaft material. In other variants, the air-permeable shaft material can be constructed from a perforated or mesh-like material. This air-permeable shaft material can be designed to be stable, so that it imparts the required shape stability to the shaft, despite these air passage openings, which extend almost or fully around the entire shaft periphery.

In one variant of this solution the at least one air passage opening has a total area of at least 50 $mm^2$, preferably at least 100 $mm^2$.

In another variant of this solution the at least one air passage opening is covered with an air-permeable protective material, for example a protective gauze or protective mesh made of metal or plastic, in order to inhibit the penetration of foreign objects, such as dirt or stones, through the air passage opening. The air-permeable protective material can be situated in the area of the lower peripheral region of the outer shaft material along the air-permeable layer, specifically either on the outside of the air passage opening or on the inside of the air passage opening, between the outer shaft material and the air-permeable layer.

In one variant of this solution the at least one air passage opening can be sealed by device. The device serves as temporary protection against outer elements, at least against spray water, so that water cannot penetrate directly through the air passage opening. The device can be designed in the form of a moveable device, for example, as a slide, by means of which the at least one air passage opening can be partially or fully closed, in order to throttle or suppress air exchange between the exterior of the shoe and the air-permeable layer. This can be particularly advantageous at low temperatures (for example, in winter), since an unduly strong cooling effect can occur as a result of the removal of sweat moisture and the related cooling effect in conjunction with air exchange through the air-permeable layer. By closing the air passage openings by means of the moveable device, excess water entry during walking in very wet surroundings can be counteracted.

In one variant of this solution a ventilator or fan, incorporated, for example, in the air-permeable layer, ensures a constant air exchange with the surroundings. The power of the fan can be controlled automatically, in order to keep a desired target temperature on the foot. The fan can be necessary especially during small or low relative movements between the shoe and the surrounding air and at high ambient temperatures, for a noticeable cooling effect.

In one variant of this solution, which involves a lasted shoe, in which a last insert of the outer shaft material on the sole side is glued onto a peripheral edge of the bottom of an inlay sole or insole (also known under the name AGO), the last insert and the inlay sole to which the last insert is glued are situated beneath the air-permeable layer.

However, this solution is not restricted to shoes with a lasted shaft, but can be used independently of the manner in which the lower area of the outer shaft material has been processed to acquire a shaft arrangement shaped on the shaft bottom side. In addition to the lasted version, the known additional versions can also be used. As examples, we can mention the Strobel version, in which the lower area of the outer shaft material is stitched onto the periphery of an inlay sole by means of a so-called Strobel seam; the string version (also known as string lasting) in which a cord tunnel, for example, in the form of a spiral loop seam, is applied to the end area of the outer shaft material on the sole side, through which cord tunnel a moving tie cord is passed, by means of which the end area of the outer shaft material on the sole side can be pulled together; and the moccasin variant, in which the shaft, except for the tongue, and the shaft bottom are made in one piece from a piece of outer shaft material, generally leather.

In one variant of this solution all components of the shoe that contribute to breathability are situated above a boundary plane between the shaft and sole. All components of the shoe, except for the outsole that touches the ground, are therefore part of the shaft arrangement. This shaft arrangement can be provided fully ready before the outsole is attached to the shaft arrangement in a second manufacturing step, separate in time and possibly in space, for production of the shoe. The outsole can be applied immediately after production of the shaft arrangement in a uniform passage through shoe manufacturing, or production of the shaft arrangement can represent the end of a closed manufacturing step, whereupon the shaft arrangement obtained in this way is brought to another production location, where the shaft arrangement is provided with the outsole. This production location can be located in the same manufacturing plant in which the shaft arrangement is produced. The production location in which the shaft arrangement is provided with the outsole can, however, also be in an entirely different location from the manufacturing location of the shaft arrangement, so that an interruption of the manufacturing process can occur between the step of producing the shaft arrangement and the step of applying the outsole to the shaft arrangement, during which interruption the finished shaft arrangement is brought to the production location for application of the outsole to the shaft arrangement. Since all components of the shoe are accommodated in the shaft arrangement except the outsole, whereby not only the shaft bottom functional layer but also the air-permeable layer are attached to the shaft bottom or form a part of the shaft bottom before the outsole is attached to the shaft arrangement, which can occur, for example, by molding on or gluing on, the production location responsible for applying the outsole to the shaft arrangement need not apply anything other than this outsole, for which normal ordinary methods and tools are sufficient. The more difficult and awkward part of shoe production, namely handling and assembling the functional layer and the air-permeable layer, is included in the production of the shaft arrangement, i.e., in a manufacturing phase, in which more complex and more complicated process steps are necessary, anyway, than in a process step in which only an outsole is attached to the shaft arrangement.

In one variant of this solution the sole is additionally provided with at least one sole passage opening which extends through its thickness. This variant results in a shoe in the foot sole area of which a removal of sweat moisture and heat is made possible both in the vertical direction through the at least one sole passage opening and in the horizontal direction through the at least one air passage opening of the outer shaft material. In addition, the at least one sole passage opening serves as an aid for improved runoff of water that has reached an area above the outsole.

In one variant of the solution a penetration protection element, for example, in the form of a nail protection plate, is arranged in or above the outsole, to produce a safety shoe. This prevents objects lying on the floor, such as nails, which could penetrate the outsole, from penetrating through it and the overlying additional elements of the sole structure and the shaft bottom into the shoe interior and injuring the foot of the user of the shoe. Such objects, such as nails, are trapped by the penetration protection element, which is a steel plate or a plastic plate, for example, with corresponding penetration resistance. Since passage openings that penetrate the outsole make no sense in such a safety shoe, because they are covered by the nail protection plate, anyway, a horizontal lateral removal of sweat moisture remains exclusively in this type of shoe for ventilation in the foot sole area and therefore improvement of climate comfort.

In one variant of this solution the air-permeable layer is formed as an air-permeable spacer structure, configured such that the air-permeable layer maintains a spacing between the layers situated beneath it and above it, even when stressed by the foot of the user of the shoe, so that the air permeability of the air-permeable layer is retained.

In one variant of this solution the air-permeable spacer structure is made to be at least partially elastic. Because of this, the walking comfort of the shoe is increased, because with this type of air-permeable spacer structure, cushioning and an easier rolling process during walking are achieved.

In one variant of this solution the air-permeable spacer structure is designed such that under maximal stress with the maximum weight of the shoe user to be expected corresponding to the shoe size in the corresponding shoe it yields elastically at most to the extent that even during such maximum stress, a significant part of the air conductivity of the spacer structure that forms the air-permeable layer is still retained. This stipulation for the air-permeable spacer structure ensures that the air-permeable spacer structure is not fully compressed with loss of its air permeability when stressed by the user of the shoe, but instead sufficiently retains the spacer function and thereby the air permeability of the spacer structure for the ventilation function, even when stressed by the user of the shoe.

In one variant of this solution the air-permeable spacer structure has a flat structure that forms a first support surface and a number of spacer elements extending away from the flat structure at right angles and/or at an angle between 0 and 90°. The ends of the spacer elements lying away from the flat structure then together define a surface by means of which a second support surface, facing away from the flat structure, can be formed.

In one variant of this solution the spacer elements of the spacer structure are designed as knobs, the free knob ends together forming the second support surface mentioned.

In one variant of this solution the spacer structure has two flat structures arranged parallel to each other, the two flat structures being joined to each other in an air-permeable manner with the spacer elements and held spaced from one another. Each of the flat structures then forms one of the two support surfaces of the spacer structure.

All the spacer elements need not have the same length in order to make the two support surfaces equidistant over the entire surface extension of the spacer structure. For special applications, it can be advantageous to make the spacer structure have different thicknesses in different zones or at different locations along its surface extension, in order to form a foot bed compatible with the foot, for example.

The spacer elements can be formed separately, in which case they are not joined to each other between the two support surfaces. However, there is also the possibility of allowing the spacer elements to touch between the two support surfaces or to fasten at least some of the contact sites formed in this manner to one another, for example, with a glue or by the fact that the spacer elements are made of materials that can be welded to each other, such as a material that becomes adhesive from heating.

The spacer elements can be rod- or thread-shaped individual elements or sections of a more complex structure, for example, a truss or lattice. The spacer elements can also be connected to each other in a zigzag or in the form of a cross-grating.

By selecting the material of the spacer elements and/or by selecting the slope angle of the spacer elements, and/or by selecting the percentage of contact sites on which adjacent spacer elements are attached to each other and/or the shape of the truss or lattice that is used, the rigidity and therefore the shape stability of the spacer structure can be adapted to the corresponding requirements, even under stress.

In one variant of this solution the spacer structure is designed to be corrugated or sawtooth-like. The two contact surfaces are then defined by the upper and lower wave peaks or the upper and lower sawtooth crests of the spacer structure.

In one variant of this solution the spacer structure is designed with a reinforced knit, wherein the reinforcement, for example, by gluing, for which a synthetic resin adhesive can be used, or by a thermal effect, in which the spacer structure is constructed with a thermoplastic material and this is heated for solidification to a softening point at which this material becomes tacky.

In one variant of this solution the spacer structure is constructed with a material chosen from the material group of polyolefins, polyamides, or polyesters.

In one variant of this solution the spacer structure is constructed with fibers, at least some of which are arranged as spacers, perpendicular between the flat structures.

In one variant of this solution the fibers are constructed with a flexible, deformable material.

In one variant of this solution the fibers consist of polyolefins, polyesters or polyamide.

In one variant of this solution the flat structures are constructed with open-pore woven, warp-knit, or knit textile materials.

In one variant of this solution the air-permeable spacer structure is formed by two air-permeable flat structures arranged parallel to each other, which are joined to each other in an air-permeable manner by means of mono- or multifilaments and spaced at the same time.

In one variant of this solution the flat structures are constructed with a material chosen from the material group of polyolefins, polyamides or polyesters.

In one variant of this solution at least some of the mono- or multifilaments of the spacer structure are arranged as spacers, roughly perpendicular between the flat structures.

In one variant of this solution the mono- or multifilaments consist of polyolefins and/or polyesters and/or polyamides.

In this solution the air-permeable layer or the air-permeable spacer structure that forms it has the function of a ventilation layer, the ventilation effect of which is due to a very low resistance to air flow. Air exchange causes an efficient removal of sweat moisture in the form of water vapor from the shoe interior to the shoe exterior.

Another advantage of this solution is in the fact that, because of the arrangement of the air-permeable layer in the shaft bottom area of the shaft arrangement, conventional soles can be used without additional modifications. In particular, in hiking shoes and trekking shoes, the border area between the sole and shaft arrangement is sealed from the outside along the shoe periphery with an additional sole band made of rubber. This band must also be perforated in the area of the air passage openings. Shell soles can then be used for variants of this solution if, for example, the air passage openings are arranged in the shaft material above the shell edge, or if the additional sole band is in turn provided with one or more corresponding air passage openings at the locations at which it comes to lie above the at least one air passage opening of the outer shaft material.

The at least one air passage opening can have any shape. In one variant of this solution, the at least one air passage opening has a round shape, for example, circular or elliptical. The shape of the at least one air passage opening, however, can also be angular, for example, it can have the shape of a square or an elongated rectangle.

In one variant of the solution according to DE 10 2008 027 856, instead of individual air passage openings a strip of air-permeable material is formed, which extends around the entire periphery of the lower area of the shaft outer material so that a particularly high air exchange can be achieved between the air-permeable layer and the outer surroundings of the shoe, with a correspondingly effective removal of heat and moisture from the shoe interior to the outer surroundings of the shoe. The air-permeable material forms a component of the shaft outer material. In one variant of this solution this can be a separate perforated, grid-like or mesh-like material fastened to the shaft outer material in its lower peripheral area on the sole side, or the shaft outer material itself can be correspondingly machined in this lower peripheral area, for example, by punching or perforation. Meshes, lattices, latticed textiles, open-pore foams, air-permeable textiles and combinations of these materials can be used as the air-permeable material. These materials can consist of polyester, polyamide, polyolefin, TPE (thermoplastic elastomers), TPU (thermoplastic polyurethane), and vulcanizates, for example.

Arranging a strip of air-permeable material in the lower area on the sole side, situated over part of the air passage openings of the shaft outer material or over all the air passage openings of the shaft outer material, or replacing the shaft outer material at the level of the air-permeable layer to form a single peripheral continuous air passage opening, is not entirely easy to accomplish if this strip of air-permeable material is supposed to run uniformly along the air passage openings or at a uniform spacing from the upper edge of the sole. This can be particularly difficult if the shoe is one in which the lower end area of the shaft outer material on the sole side is fastened to a lower peripheral area of a shaft bottom, for example, an inlay sole, by glue lasting, specifically due to the high lasting forces that must be applied during glue lasting. High tensile forces also occur in shoes in which the lower end area of the shaft outer material on the sole side is fastened to a lower peripheral area of an inlay sole by means of a seam.

Such problems are overcome with the footwear designed according to the invention according to claim 1. Variants of the footwear designed according to the invention are claimed in the dependent claims.

The footwear according to one variant of the invention has a shaft arrangement and a sole, the shaft arrangement having a shaft outer material and an air-permeable layer arranged in a shaft bottom. The air-permeable layer is arranged in a lower area of the shaft arrangement on the sole side, above the sole. The air-permeable layer has a three-dimensional structure that permits the passage of air at least in the horizontal direction. A lower peripheral area of the shaft outer material on the sole side is replaced over at least part of its peripheral extent by at least one connection material, which, beginning at least above a bottom of the air-permeable layer and running outside the air-permeable layer, is fastened to the shaft bottom and is air permeable, at least in a partial area, at least part of which extends at the same height as the air-permeable layer, and because of this, said connection material connects the air-permeable layer to the outer surroundings in such a way that air can be exchanged between the outer surroundings and the air-permeable layer.

Through the measure according to the invention of having at least part of the actual shaft outer material stop above or at the level of the air-permeable layer and replacing it up to the lower end of the shaft structure on the sole side with a connection material, which is air permeable at least in the area that lies at the level of the air-permeable layer, the possibility is achieved, at relatively limited expense, of creating a shaft structure that guarantees a reliable air-permeable covering of the air-permeable layer with an orderly appearance.

In one variant, the connection material is fastened to the shaft bottom by glue lasting on the bottom of a bottom layer of the shaft, which can be the air-permeable layer or an inlay sole, for example. In this case the lower end of the connection material forms the last insert.

For the case in which a shaft liner is situated on the inside of the shaft outer material, this can also be fastened by last assembly, especially glue lasting, or in another way, for example, by using a Strobel seam, i.e., fastening with a Strobel seam to a shaft liner inlay sole.

The air-permeable connection material has two essential functions. In the first place it ensures that air can be exchanged between the air-permeable layer and the outer surroundings. In the second place the connection material serves for fastening of the shaft outer material to the shaft bottom, for example, to an inlay sole or to the air-permeable layer. This fastening process includes all known methods for producing a shaft arrangement, such as lasting, Strobel seams or string-lasting.

The connection material can be in the form of a strip, especially in the form of an extension strip.

The connection material can be embodied as air-permeable over its entire width or over only a part of its width, which after the fastening process is located at the level of the air-permeable layer.

The connection material can run around the entire lower peripheral area of the shaft outer material.

Mesh-like or latticed materials are particularly well suited as material for the connection material. The connection material is preferably formed by a lattice band or mesh band. Said band can have openings of roughly uniform size over its entire width. In one variant the lattice or mesh band can be provided with larger openings in the area allocated to the air-permeable layer than in the fastening area, for example, in the lasting area of the connection material, in order to achieve the largest possible air permeability. In this way, wherever particularly high forces occur, namely in the fastening area, higher strength and load capacity is ensured than is required in the area of the connection material, opposite the air-permeable layer. Since the connection material must assume the main load during the fastening process and during use, a correspondingly stable material should be chosen for the connection material, whereas for the actual shaft outer material, which is freed by the connection material from this main load, greater freedom is obtained with respect to material selection.

In general, the connection material should be characterized by a high abrasion strength, high penetration resistance (relative to stones, twigs, etc.), gluability and stitchability. It is also advantageous for the connection material not to fray at the cutting edges.

Mechanical protection, dirt- and water-repellant properties, as well as visual effect play an important role in material selection for the connection material. Meshes, lattices, latticed textiles, open-pore foams, air-permeable textiles, three-dimensional knits, knits, woven fabrics, warp-knit fabrics, air-permeable lays, materials from inorganic fibers like glass fibers or carbon fibers, or combinations of these materials can be used as the air-permeable connection material.

In principle, the connection material can consist of any technical thermoplastics, thermosetting plastics and elastomers. Special metals or combinations of plastic and metal, metalized polymers or metal knits can also be considered. Examples of plastic are PUR (polyurethane), polyester, polypropylene, polyamide, polyolefins, TPE (thermoplastic elastomers), TPU (thermoplastic polyurethane), EPDM (ethylene-propylene-diene rubber), SAN (styrene-acrylonitrile copolymers), SBR (styrene-butadiene rubber), ABS (acrylonitrile-butadiene-styrene), vulcanizates, silicones and combinations of these materials. Rubber can also be used for the connection material. The connection material can also have at least one air-permeable membrane or one air-permeable film.

For example, the connection material can also have at least two material areas that are different from each other.

The connection material can comprise one component or several components.

In one variant, the connection material has several components, for example, in the form of a composite material. In one variant the composite material is formed with a coated or impregnated lattice band or mesh band, like a rubberized textile, for example. A coating/impregnation can also have an acrylate, silicone, or polyurethane base. It is generally advantageous for the air-permeable connection material to be hydrophobic.

In another variant, the coating of the air-permeable connection material simultaneously serves as the glue for fastening additional materials or for fastening to additional materials. For example, by means of the coating, a cover strip that is provided with air-permeable openings, which covers at least parts of the connection material, can be fastened to the connection material without additional glue. In another example the coating serves as lasting glue. In one variant a lattice band or mesh band (lattice-like textile) is coated with polyurethane, which acts as a glue when heated. It must be ensured that sufficient glue is applied to the lattice or mesh band to produce an adhesive connection.

It is also possible to use prefabricated composite materials, such as a rubber band provided with air-permeable openings, which has been reinforced/strengthened with fibers or a textile structure (mesh or lattice). Only the mesh or lattice is situated in the openings of the rubber band. A prefabricated connection material can also be connected to an additional component, for example, it can include a lattice band glued to a rubber band. In such cases the rubber band assumes the function of the aforementioned cover strip, which will be explained in greater detail below. It is therefore possible to integrate a separate cover strip into the connection material. In this manner, additional work steps are saved and production of the shaft arrangement is simplified.

The connection material can also have different material properties and/or physical properties over its width. For example, the connection material can have particularly high air permeability in the area of the air-permeable layer, but low air permeability in the lower fastening area. Additional different properties can include stretchability, strength and/or thickness. For example, in one variant the connection material is embodied as thinner in the lower area, which is used for fastening to the bottom of the shaft. The result is that the air-permeable openings do not slide or deform during fastening of the connection material to the bottom of the shaft, and are permanently situated at the same level as the air-permeable layer.

The connection between the lower end area of the actual shaft outer material and the upper end area of the connection material can be produced, for example, by gluing, welding or stitching.

In one variant of the invention, a cover strip is situated on the outside of the shaft beginning from at least a part of the upper peripheral edge of the sole, which strip extends over an upper end of the connection material to the shaft outer material and is air permeable at least in part of the area that covers those parts of the connection material which are situated at least partially at the level of the air-permeable layer.

Such a cover strip is especially a protective band which is applied especially in so-called hiking shoes in the usual manner on the lower end of the shaft, continuously around its periphery, in order to form a protection for this region of the shaft, which is exposed to particularly high abrasive loads especially during mountain hiking. A cover strip of this type often consists of rubber or rubber-like plastic, for which reason the term "rubber band" is also frequently used for such cover strips. This cover strip need not be an actual rubber band, but a reinforced textile material can also be used for this purpose, which is naturally abrasion-resistant or is provided with an abrasion-resistant finish.

To avoid adversely affecting the air permeability to the outer surroundings in the area of the air-permeable layer, the cover strip is also embodied as air permeable, at least in the area situated at the level of the air-permeable layer. In particular, if the material of the cover strip is rubber or rubber-like plastic, the cover strip is given this air permeability by perforations, recesses, or cutout areas, at least in the area in which it is opposite the air-permeable layer and therefore must be air permeable.

The cover strip is situated on the outside of the connection material and advantageously extends over the area where the connection between the actual shaft outer material and the connection material is situated. In this way, this connection area is concealed and not visible from the outside, which is useful for a pleasing appearance of the footwear.

The cover strip can also be connected at its lower end on the sole side to the bottom of the shaft, for example, by a lasting process. This can occur by lasting it via glue lasting, thereby firmly gluing it, to the bottom of the connection material, which is lasted to the air-permeable layer, for example. This has the advantage that the lasting forces need not be taken up by the connection material alone, but can be distributed to the connection material and the cover strip. In another variant the cover band is connected, for example, glued, welded or stitched to the connection material and then both are fastened to the bottom of the shaft by means of a lasting process.

DEFINITIONS

Horizontal, Vertical:

Applies during viewing of the corresponding object, for example, a sole or shaft arrangement, in a defined position in which this object lies on a flat substrate.

Inside, Outside:

Inside means on the side that faces the shoe interior; outside means on the side that faces the shoe exterior.

Top, Bottom:

Top means on the side that faces away from the walking surface of the sole of the shoe; bottom means on the side that faces the walking surface of the sole of the shoe or the side that faces the substrate on which the shoe stands, again under the assumption that the substrate is flat.

Shoe or Footwear:

Footwear with a closed upper part (shaft arrangement), having a foot insertion opening and at least one sole or a sole composite.

Shaft Arrangement:

Encloses the foot completely up to a foot insertion opening, and in addition to the shaft, also has a shaft bottom. The shaft arrangement can also have one or more linings, for example, in the form of a liner and/or a waterproof, water vapor-permeable functional layer and/or one or more insulation layers.

Shaft Outer Material:

A material that forms the outside of the shaft and therefore forms the shaft arrangement and consists, for example, of leather, textile, plastic, or other known materials or combinations thereof or is constructed with them. Generally, these materials and combinations are water vapor-permeable. The lower peripheral area of the outer shaft material on the sole side describes an area adjacent to the upper edge of the sole or above a boundary plane between the shaft and the sole.

Shaft Bottom:

A lower area of the shaft arrangement on the sole side, in which the shaft arrangement is fully or at least partially closed. The shaft bottom is situated between the foot sole and the outsole. In shoes with a lasted or Strobel shaft, the shaft bottom can be formed with cooperation of an inlay sole (insole). The shaft bottom can also be provided with a shaft bottom functional layer or a shaft bottom functional layer laminate, wherein this laminate can also assume the function of the inlay sole. In footwear according to the invention the shaft bottom also includes the air-permeable layer.

Sole:

The term sole serves as the generic term for soles or sole layers of any type.

Inlay Sole (Insole):

An inlay sole is the part of the shaft bottom to which a lower shaft end area on the sole side is attached. The inlay sole can be provided exclusively for this purpose, in which case one often speaks of insoles. However, a sole layer situated in the shaft bottom can also serve as an inlay sole, which is initially arranged there for a different purpose and is also used for the function of the inlay sole, for example, the air-permeable layer present in the footwear according to the invention. The inlay sole can be water vapor-permeable and, for example, the inlay sole can be formed from a water vapor-permeable material or can be made water vapor-permeable by means of openings (holes, perforations), which are formed through the thickness of the inlay sole. In this case the inlay sole has a water vapor permeability number Ret of less than 150 $m^2 \times Pa \times W^{-1}$. The water vapor permeability is tested according to the Hohenstein skin model. This test method is described in DIN EN 31092 (02/94) and ISO 11092 (1993).

Sole:

A shoe has at least one outsole, but it can also have several types of soles arranged one above another.

Outsole:

Outsole is understood to mean that part of the sole area that touches the ground/floor or produces the main contact with the ground/floor. The outsole has at least one walking surface that touches the floor.

Midsole:

In the event that the outsole is not directly applied to the shaft arrangement, a midsole can be inserted between the outsole and shaft arrangement. The midsole can serve as a cushion, damping or as filler material, for example.

Bootie:

A sock-like inner lining of a shaft arrangement is referred to as a bootie. A bootie forms a sack-like lining of the shaft arrangement that essentially fully covers the interior of the footwear.

Functional Layer:

Water vapor-permeable and/or waterproof layer, for example, in the form of a membrane or a correspondingly treated or finished material, for example, a textile with plasma treatment. A functional layer in the form of a shaft bottom functional layer can form at least one layer of a shaft bottom of the shaft arrangement, but it can also be additionally provided as a shaft functional layer that at least partially lines the shaft; when both the shaft functional layer and a shaft bottom functional layer are present, they can be parts of a multilayer, generally a two-, three- or four-layer laminate; if a shaft functional layer and a separate shaft bottom functional layer are used instead of a functional-layer bootie, these are sealed so as to be waterproof in the lower area of the shaft arrangement on the sole side, for example; the shaft bottom functional layer and shaft functional layer can also be formed from one material.

Appropriate materials for the waterproof, water vapor-permeable functional layer are especially polyurethane, polyolefins, and polyesters, including polyether esters and laminates thereof, as described in documents U.S. Pat. No. 4,725,418 and U.S. Pat. No. 4,493,870. In one variant, the functional layer is constructed with microporous, expanded polytetrafluoroethylene (ePTFE), as described, for example, in documents U.S. Pat. No. 3,953,566 and U.S. Pat. No. 4,187,390, and expanded polytetrafluoroethylene, provided with hydrophilic impregnation agents and/or hydrophilic layers; see, for example, document U.S. Pat. No. 4,194,041. Microporous functional layers are understood to mean functional layers whose average effective pore size is between 0.1 and 2 μm, preferably between 0.2 μm and 0.3 μm.

Laminate:

A laminate is a composite consisting of several layers permanently joined together, generally by mutual gluing or welding. In a functional layer laminate, a waterproof and/or water vapor-permeable functional layer is provided with at least one textile layer. The at least one textile layer serves mostly to protect the functional layer during its processing. This refers to a two-layer laminate. A three-layer laminate consists of a waterproof, water vapor-permeable functional layer embedded in two textile layers. The connection between the functional layer and the at least one textile layer occurs by means of a discontinuous glue layer or a continuous water vapor-permeable glue layer, for example. In one variant, a glue can be applied spot-wise between the functional layer and the one or two textile layers. Spot-wise or discontinuous application of glue occurs because a full-surface layer of a glue that is not water vapor-permeable itself would block the water vapor permeability of the functional layer.

Waterproof:

A functional layer/functional-layer laminate is considered "waterproof," optionally including the seams provided on the functional layer/functional-layer laminate, if it guarantees a water-entry pressure of at least $1\times10^4$ Pa. The functional layer material preferably withstands a water-entry pressure of more than $1\times10^5$ Pa. The water-entry pressure is then measured according to a test method in which distilled water at 20±2° C. is applied to a sample of 100 $cm^2$ of the functional layer with increasing pressure. The pressure increase of the water is 60±3 cm $H_2O$ per minute. The water-entry pressure then corresponds to the pressure at which water first appears on the other side of the sample. Details concerning the procedure are stipulated in ISO standard 0811 from the year 1981.

Whether a shoe is watertight can be tested, for example, with a centrifuge arrangement of the type described in U.S. Pat. No. 5,329,807.

Water Vapor-Permeable:

A functional layer/functional-layer laminate is considered "water vapor-permeable" if it has a water vapor-permeability number Ret of less than 150 $m^2\times Pa\times W^{-1}$. Water vapor permeability is tested according to the Hohenstein skin model. This test method is described in DIN EN 31092 (02/94) and ISO 11092 (1993).

Air Permeable:

"Air permeable" in the present application is understood to mean the convective exchange of air and water vapor by means of air flow and the exchange of water vapor by means of pure diffusion processes or combinations thereof.

Air-Permeable Layer:

The air-permeable layer has a three-dimensional structure that permits air passage in at least the horizontal direction. This structure has a low flow resistance for air. The air-permeable layer permits the absorption and transport of heat and water vapor from the shoe interior by means of convection, for example. The air-permeable layer contains an air volume of at least 50%, in one variant more than 85%. The thickness of the air-permeable layer can be less than 12 mm, wherein the thickness in one variant is less than 8 mm. The air-permeable layer has a basis weight of less than 2000 $g/m^2$, preferably less than 800 $g/m^2$. The air-permeable layer covers at least 50% and preferably at least 70% of the foot standing surface of the shaft bottom. The air-permeable layer also has a structure with a stiffness such that it is not significantly permanently compressed by the foot of the user during walking.

A spacer structure as known from DE 102 40 802 A2 is suitable as the air-permeable layer, for example, but there it is in conjunction with an infrared-reflecting material for clothing articles.

The air-permeable layer can be a shaped structure from polymers, a 3D spacer structure, or a textile structure reinforced with polymer resins, for example. The air-permeable layer can also be produced by an injection-molding method. In one variant, it can have a channel- or tube-like configuration or can be formed from polymer or metal foams.

Shaped structures from polymers are based on polymer monofilaments, woven fabrics, nonwoven fabrics or lays, which are formed by deformation and fixation of the materials to a rib, knob, or zigzag structure. The structure can also be a three-dimensional structure, for example, from polypropylene, in the form of a wave-like or other shape of filament lay brought to a 3D structure. Deformation and fixation can be carried out, for example, by means of a heated structuring roll or as a thermoforming process. The shaped structures can additionally be laminated with a woven or nonwoven fabric in order to improve dimensional stability. One possible method for producing such shaped structures is described, for example, in patent application WO 2006/056398 A1.

The air-permeable layer can also be formed from a 3D spacer structure. Such spacer structures can generally consist of polyester multi- or monofilaments. Spacer structures can be spacer knits, spacer warp-knits, spacer nonwoven fabrics or spacer woven fabrics. Knitting technology makes it possible to vary the top and bottom of the product surfaces and the spacer threads (pole threads) independently of each other. Thus the surfaces and the hardness, including the spring characteristic, can be adjusted according to the individual application. Spacer structures are characterized by very high air circulation in all directions, even under stress.

The spacer structure, for example, in the form of a spacer knit, can also be produced by impregnating textile fabrics that are impregnated before or after deformation to a three-dimensional structure with synthetic resin and thus acquire the desired rigidity.

Inorganic fibers, such as glass fibers or carbon fibers, can also be chosen as the fiber material for the spacer structure.

TABLE 1

Selection of possible usable materials for the air-permeable layer

| Sample | Manufacturer | Characteristic | Product name | Thickness in mm | Basis weight in $g/m^2$ | Air volume in % | Polymer |
|---|---|---|---|---|---|---|---|
| 1 | Colbond BV | 3D mat structure from monofilaments, thermally deformed to a zigzag structure | ENKA spacer: 8006H 5006C 7004H | 3-12 | 100-2000 | >70 >90 | Polyester Polyamides Polyolefins |
| 2 | Colbond BV | 3D mat structure from monofilaments that are welded to one another on their inner section points | ENKA spacer: 7008 | 3-12 | 100-2000 | >70 >90 | Polyester Polyamides Polyolefins |

TABLE 1-continued

Selection of possible usable materials for the air-permeable layer

| Sample | Manufacturer | Characteristic | Product name | Thickness in mm | Basis weight in g/m$^2$ | Air volume in % | Polymer |
|---|---|---|---|---|---|---|---|
| 3 | Muller Textile | 3D spacer structure | 3-mesh | 3-12 | 100-1500 | | Polyester monofilament or multifilament |
| 4 | Tylex Letovice A.S. | 3D spacer structure | Tyl-space | 3-12 | 100-1500 | | Polyester monofilament or multifilament |

To summarize, the air-permeable layer should maintain a spacing between the foot and the outsole and form a number of passages that produce the least possible resistance to air flow and therefore contribute to the transport of water vapor and heat without adsorbing the water vapor. The air-permeable layer has no or at least essentially no capillary effect. The air-permeable layer is closed on the bottom by the inlay sole and/or a filler layer and/or the outsole, and is open at least on its periphery in a manner that permits air permeability. The air-permeable layer is preferably also open on its upper surface in a manner that permits air permeability. The upper surface of the air-permeable layer directed toward the shoe interior in one variant is directed toward a waterproof and optionally also water vapor-permeable functional layer.

The air permeability of the spacer structures is determined according to DIN EN ISO 9237 "Determination of Air Permeability of Textile Fabrics." In contrast to DIN EN ISO 9237, the flow rate and pressure difference are not measured perpendicular to the surface, but along the surface. For this purpose, a defined spacer channel bounded by closed cover surfaces is constructed, in which an air stream is supplied from one side. The pressure difference between the inlet and outlet from the channel and the flow rate at the air outlet are measured. At pressure differences between 0 and 100 Pa at the end of a channel between 300 mm and 1300 mm long, flow rates between 0 and 1 m/s were measured. This means that a spacer structure that no longer generates a measurable flow at the outlet at a static pressure up to 100 Pa and a flow channel length of 300 mm would not be suitable for the present invention.

Air Passage Opening:

Includes at least one opening in the lower peripheral area of the outer shaft material on the sole side. At least two roughly opposite air passage openings are preferably present. The air passage openings can be introduced by means of punching out, cutting out, or perforation in the outer shaft material, for example. The air passage opening can be any shape, for example, round or angular. The air passage opening can be protected with an air-permeable surface-protection material, for example, in the form of a mesh or gauze, against penetration by foreign objects. The protective material can be finished to be hydrophobic. The total area of the at least one air passage opening is at least 50 mm$^2$, preferably at least 100 mm$^2$. In an alternative variant, the air passage opening can also be formed directly by an air-permeable material, which can be used as outer shaft material or as a component of the outer shaft material, and it inherently has the necessary air permeability, so that no additional openings need be created.

Lasting, Glue Lasting:

this is a type of fastening of the lower end area of an upper layer, for example, the shaft outer material or a shaft liner, to the bottom of an inlay sole (for example, insole or air-permeable layer), generally by means of glue lasting. The shaft still open on the sole side is then stretched over a last in such a way that the lower end area of the shaft outer material protrudes over the last and this protruding part of the shaft outer material is pulled by lasting tongs onto a bottom peripheral edge of the inlay sole and firmly glued there by means of lasting glue.

Connection Material:

An elongated piece of material that consists entirely or at least partially of air-permeable material and whose longitudinal dimension extends beyond the periphery of the shaft or at least a part thereof, said material being fastened to a lower end area of the shaft outer material on the sole side. In the case according to the invention one or more lengthening strips are fastened to individual peripheral partial areas or on the entire peripheral area of the lower end of the shaft outer material.

Cover Strip (for Example, Rubber Edge):

An elongated strip, especially made of rubber of rubber-like material, which extends at the lower end of the shaft around entire periphery or at least a large part thereof, and offers protection, especially abrasion protection, for the area of the shaft that is covered by this strip. The cover strip can extend upward from the outsole. The cover strip can be integrated into the outsole or can be a separate part from the outsole.

The invention will now be further explained by means of variants.

FIGS. 1 to 14 show the solution explained above and disclosed in the already mentioned DE 10 2008 027 856, whereas FIGS. 15 to 19 are devoted to the present invention.

Figure 1:
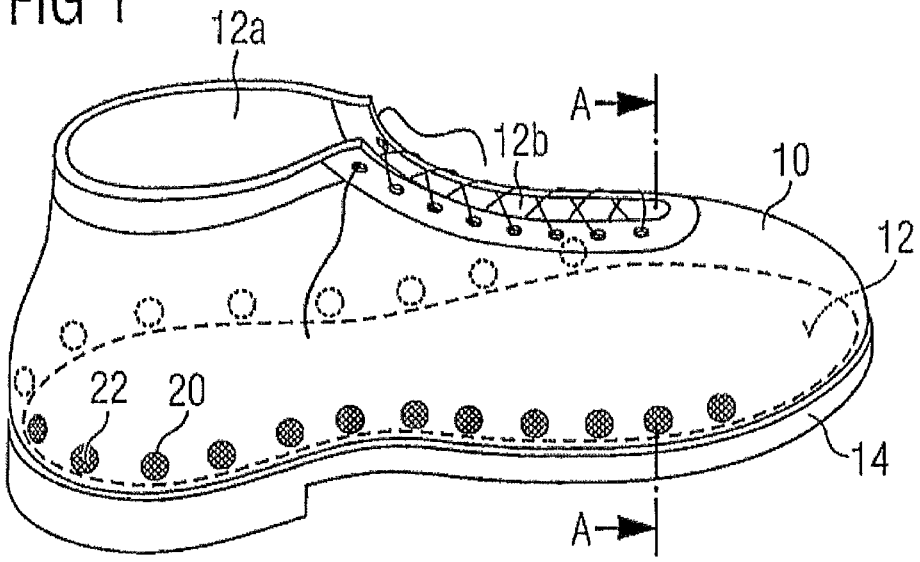
FIG. 1 shows a perspective oblique view of a first embodiment example of a shoe designed according to DE 10 2008 027 856 with several air passage openings in the shaft outer material.

FIG. 1 shows a first embodiment example of a shoe 10 according to DE 10 2008 027 856, which has a shaft arrangement 12 and a sole 14 applied to the lower end area of the shaft arrangement 12, wherein this embodiment example involves an outsole. The shaft arrangement 12, in the usual manner, has on its upper end a foot-insertion opening 12*a*, from which a lace area 12*b* extends in the direction of the forefoot area of the shaft arrangement 12. In the lower end area of the shaft arrangement 12, a number of air passage openings 20 arranged around part of the periphery of the shaft arrangement 12 can be seen. In the front part of the forefoot area, which corresponds roughly to the toe area of the shoe, no air passage openings are provided in this embodiment. The air passage openings 20 are uniformly distributed around the remaining peripheral area of the shaft arrangement 12, with roughly the same spacing, and are formed to be circular. The air passage openings 20 are also provided with an air-permeable protective covering 22, in order to prevent the penetration of large particles, such as stones. The protective covering 22 can cover the air passage opening from the outside and/or from the inside. A protective covering 22 can be applied to each individual air passage opening 20, or an overall protective covering 22 can extend over all air passage openings. The protective covering 22 can be designed, for example, to be gauze-like or mesh-like.

Figure 2:
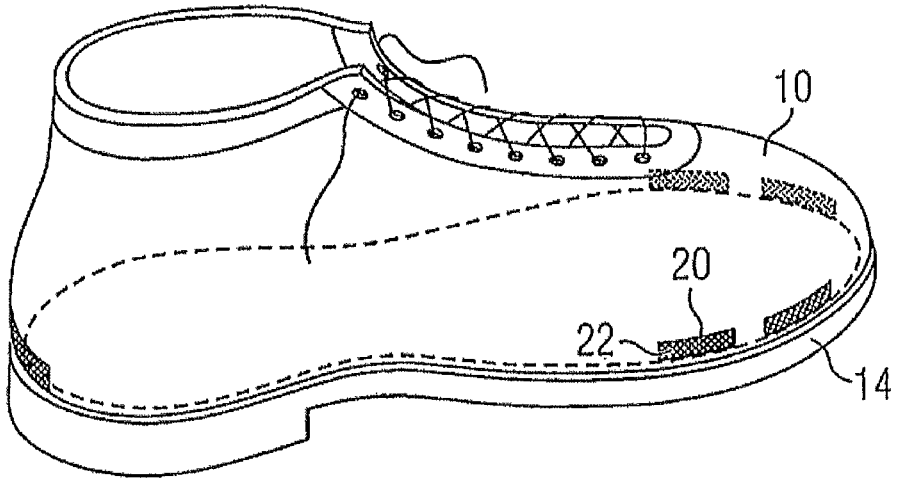
FIG. 2 shows a perspective oblique view of a second embodiment example of a shoe designed according to DE 10 2008 027 856 with several air passage openings in the shaft outer material.

FIG. 2 shows a second embodiment example of a shoe 10 according to DE 10 2008 027 856, which largely agrees with the first embodiment example shown in FIG. 1, but differs from the first embodiment example with respect to the arrangement and shape of the air passage openings 20. The air passage openings 20 of the shoe shown in FIG. 2 have an elongated rectangular shape in the peripheral direction of the shaft arrangement 12 and are situated in the forefoot area or heel area of the shaft periphery in the lower end area of the shaft arrangement. The air passage openings 20 also have a gauze-like protective covering 22.

Figure 3:
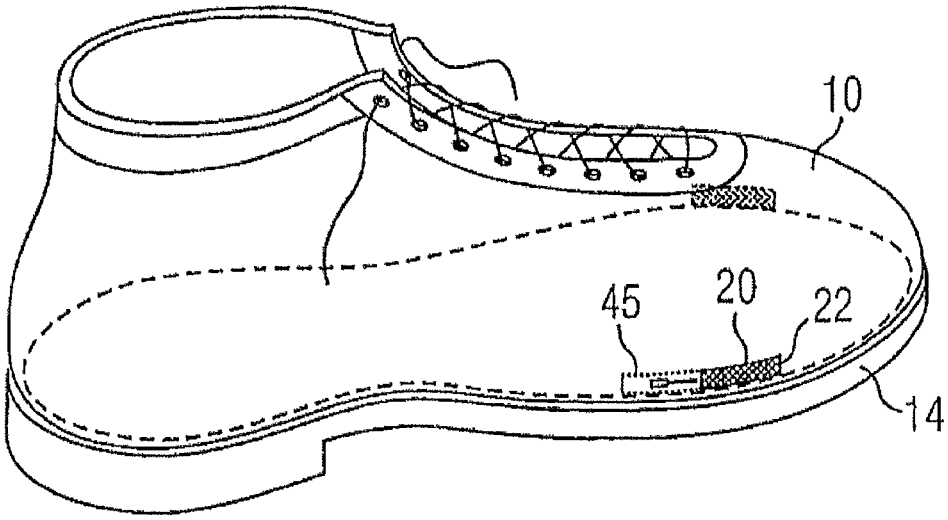
FIG. 3 shows a perspective oblique view of a third embodiment example of a shoe designed according to DE 10 2008 027 856 with several partially closable air passage openings in the shaft outer material.

FIG. 3 shows a third embodiment example of a shoe 10 according to DE 10 2008 027 856, which largely agrees with the second embodiment example shown in FIG. 2, but differs from the second embodiment example with respect to the arrangement of the air passage openings 20. In the third embodiment example, the air passage openings 20 also have an elongated rectangular shape in the peripheral direction of the shaft arrangement 12. However, air passage openings 20 that are at least roughly opposite each other in the transverse direction of the foot are situated only in the forefoot area of the shaft periphery. The air passage openings 20 are covered with a grid-like protective covering 22.

FIG. 3 also shows a device 45 that is also representative for all variants of FIGS. 1 to 4, by means of which the air passage openings 20 can be closed as required. The movable device 45 shown includes means by which an at least water-repellant material temporarily closes the air passage opening 20. In the variant shown, an at least water-repellant material can be pushed by means of a slide device along the shaft periphery over the air passage opening 20, until it is closed. The slide device can be provided for one air passage opening or for several air passage openings. The movable device 45 makes it possible for the air passage opening and therefore the air-permeable layer (not shown) of the shaft arrangement 12 to be temporarily protected against the penetration of liquids such as water. Closure of the air passage openings can also be advantageous in the winter or at very cold temperatures, since unduly severe cooling of the foot can thereby be prevented. Plugs, slides, flaps, a continuous band, and all other closure mechanisms can be used as devices for closure of the air passage openings. Possible materials for closure of the air passage opening can be plastics, foams, coated textiles, TPU, TPE, silicone, polyolefins, polyamides, and vulcanizates.

Figure 4:
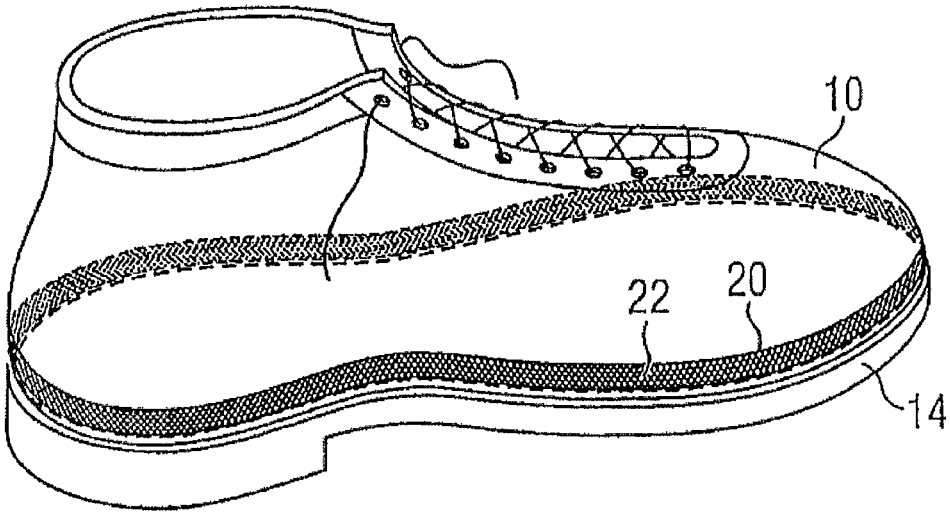
FIG. 4 shows a perspective oblique view of a fourth embodiment example of a shoe designed according to DE 10 2008 027 856 with an air-permeable grid-like component of the outer shaft material enclosing the shaft periphery.

FIG. 4 shows a fourth embodiment example of a shoe 10 according to DE 10 2008 027 856 which largely agrees with the first embodiment example shown in FIG. 1, but differs from the first embodiment example in that the air passage openings 20 are formed by an air-permeable material that extends around the entire periphery of the lower shaft area. Particularly high air exchange can thereby be achieved between the air-permeable layer and the outer surroundings of the shoe 10, with a correspondingly effective removal of heat and moisture from the shoe interior to the outer surroundings of the shoe 10. The air-permeable material is a component of the outer shaft material. In one variant, it can be made of a separated perforated, grid-like or mesh-like material, which is attached in the lower peripheral area of the outer shaft material on the sole side, or the outer shaft material itself is correspondingly treated mechanically in this lower peripheral area, for example, by punching or perforation. Meshes, gauzes, gauze-like textiles, open-pore foams, air-permeable textiles, and combinations of these materials can be used as the air-permeable material. These materials can consist, for example, of polyesters, polyamides, polyolefins, TPE, TPU, or vulcanizates.

All variants in FIGS. 1 to 4 have the common feature that at least two air passage openings are at least roughly opposite each other in the transverse direction of the foot or the longitudinal direction of the foot. Because of this, air flow can form through the air-permeable layer, which is essential during the removal of water vapor and heat from the shoe interior by convection. The air flow can also be actively generated with an incorporated fan.

The variants in FIGS. 1 to 4 can also be combined with one another.

FIGS. 5 to 9 each show a cross section through a part of the forefoot area of a shoe according to DE 10 2008 027 856, especially along line A-A in FIG. 1. While such a line is shown only in FIG. 1, the cross-sectional views of FIGS. 5 to 9 also apply to the variants shown in FIGS. 2 to 4. FIGS. 5 to 9 each show a shaft arrangement 12 with a sole 14 applied to it, which represents an outsole in the shown variant. The variants shown in FIGS. 5 to 9 differ with respect to the corresponding shaft arrangement 12.

Figure 5:
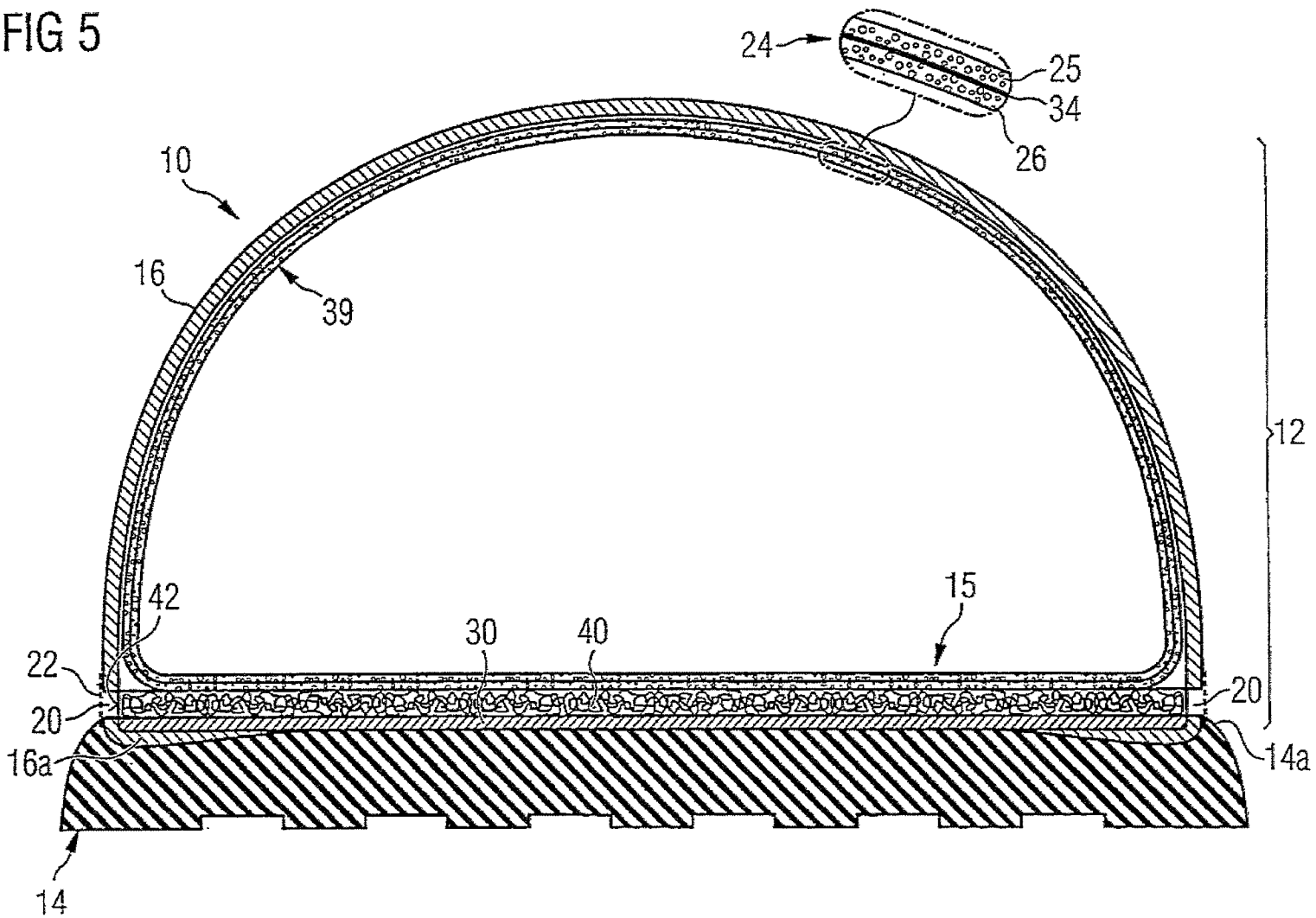
FIG. 5 shows a schematic view of a cross-section through part of the forefoot area of a shoe designed according to one of the variants shown in FIGS. 1 to 4, in a first variant of its shaft arrangement.
Figure 6:
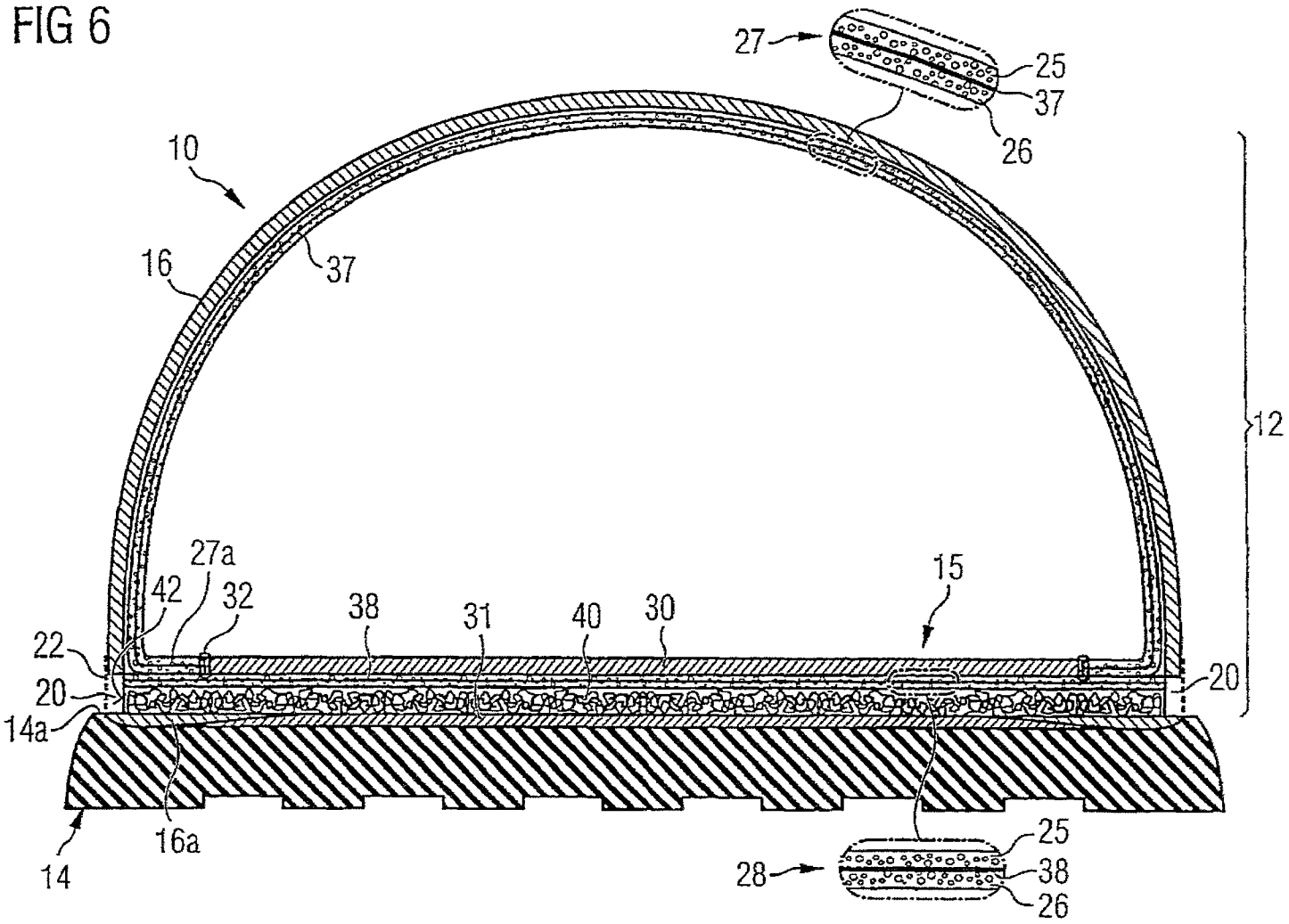
FIG. 6 shows a schematic view of a cross-section through part of the forefoot area of a shoe designed according to one of the variants shown in FIGS. 1 to 4, in a second variant of its shaft arrangement.
Figure 7:
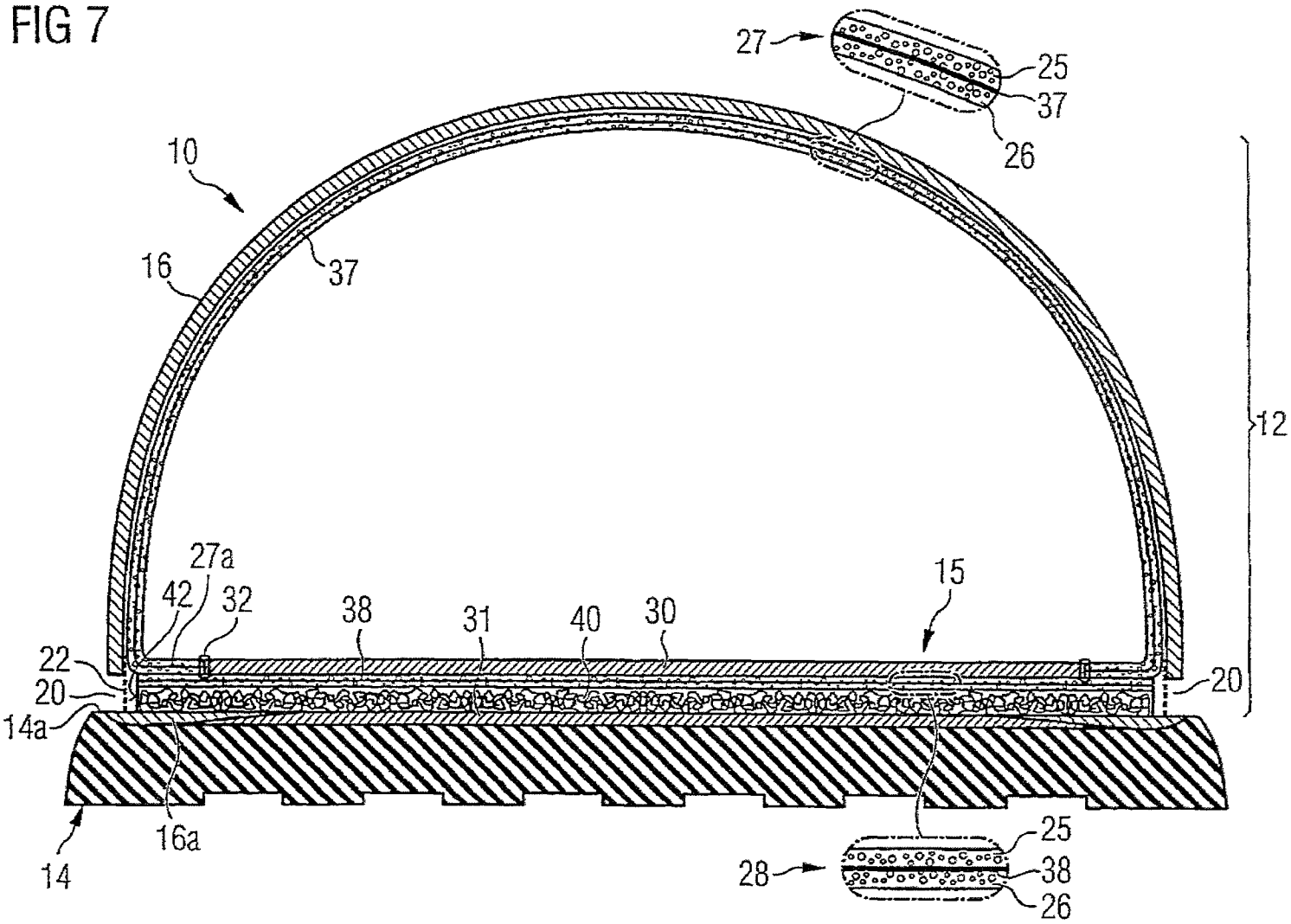
FIG. 7 shows a schematic view of a cross-section through part of the forefoot area of a shoe designed according to one of the variants shown in FIGS. 1 to 4, in a third variant of its shaft arrangement.
Figure 8:
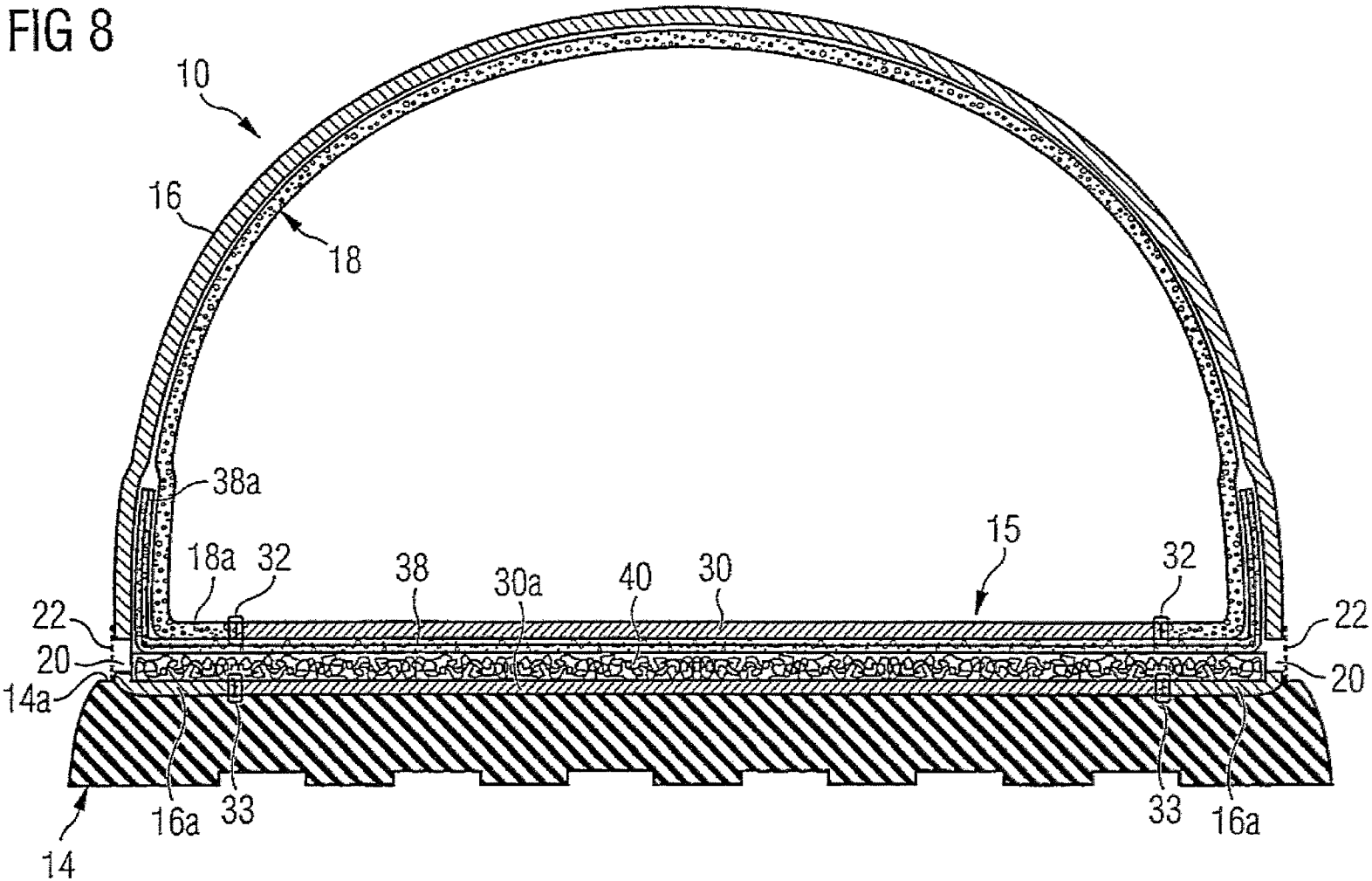
FIG. 8 shows a schematic view of a cross-section through part of the forefoot area of a shoe designed according to one of the variants shown in FIGS. 1 to 4, in a fourth variant of its shaft arrangement.

All shaft arrangements 12 of the variants in FIGS. 5 to 9 have an outer shaft material 16, on the inside of which a lining is situated, which has either a bootie functional layer 34 (FIGS. 5 and 9), a shaft functional layer 37 (FIGS. 6 and 7), or only a liner layer 18 without a functional layer (FIG. 8). In all five variants, a shaft bottom functional layer is situated in the area of the shaft bottom 15. The shaft functional layer and the shaft bottom functional layer can be common parts of a functional layer bootie 39 (FIG. 5 or 9), or they can be separate functional-layer parts that are sealed with respect to one another (FIGS. 6 and 7). In FIG. 8, only the shoe bottom has a functional layer. All these functional layers in the embodiment examples shown are part of a multilayer functional layer laminate, of a three-layer functional layer laminate 24, 27, or 28 in the variants shown, with a functional layer 34, 37, or 38, which is embedded between two textiles 25 and 26. The textiles in 25 and 26 can usually be one textile layer each. The shaft functional layer 37, or the shaft functional layer laminate 27 (FIGS. 6 and 7), or the liner layer 18 (FIG. 8) can be attached to an inlay sole 30 by means of a Strobel seam 32. An air-permeable layer 40 (FIGS. 5 to 9) is situated beneath the shaft bottom functional layer 38 or the shaft bottom functional layer laminate 28, specifically at least at about the height of the at least one air passage opening 20. The lower end area of the outer shaft material 16 on the sole side is either glue-lasted or attached as a last insert 16*a* by means of lasting glue (not shown) on the bottom of the inlay sole 30 (FIGS. 5 and 9) or the air-permeable layer 40 (FIGS. 6 and 7). Or the lower end area of the shaft upper material 16 on the sole side is connected by means of an additional Strobel seam 33 to an additional inlay sole 30*a* (FIG. 8).

In all the variants shown in FIGS. 1 to 9, the outer material 16 is constructed with a water vapor-permeable material. The inlay sole 30 arranged above the shaft bottom functional layer laminate 28 (FIGS. 6 to 8) and the liner layer 18 (FIG. 8) are also constructed with water vapor-permeable material. All layers of the shaft bottom situated beneath the air-permeable layer 40, such as the inlay sole 30 in FIG. 5, the filling layers 31 in FIGS. 6 and 7, and the additional inlay sole 30*a* in FIG. 8 need not have water vapor permeability.

In the variants of FIGS. 5 to 9, the air passage openings 20 of the outer shaft material 16 are situated directly above the angled area of the inserted lower end area of the outer shaft material 16, specifically at a height such that the air passage openings 20 are at least at roughly the same height as the peripheral side surfaces 42 of the air-permeable layer 40. In order to achieve particularly effective air passage between the air-permeable layer 40 and the air passage openings 20, the air passage openings 20 preferably have a vertical extension roughly equal to the vertical thickness of the air-permeable layer 40, and the air passage openings 20 and the air-permeable layer 40 are aligned with respect to each other in the vertical direction such that a horizontal middle plane of the air-permeable layer 40 and a center axis of the corresponding air passage opening 20 are at least at roughly the same vertical height.

In all five variants, the sole 14 is connected to the lower area of the shaft arrangement 12 in such a way that it is connected to the bottom of the lower end area 16*a* of the outer shaft material 16 forming the insert, and to the area of the bottom of the shaft bottom that is not covered by this insert. Unevenness on the bottom of the shaft bottom, caused in particular by a last insert 16*a* of the outer shaft material 16, can be compensated by a filler layer 31. The sole 14 can be constructed with waterproof material, in which rubber or a rubber-like elastic plastic, for example, an elastomer, is involved. The sole 14, however, can also consist of a water vapor-permeable material, such as leather. The sole 14 can be a prefabricated sole glued to the shaft arrangement 12 or a sole molded onto the shaft arrangement 12. A walking surface of this sole, situated on the bottom of the sole 14, is provided in the usual manner with a groove pattern, in order to form profile protrusions that improve the anti-slip characteristics of the shoe 10 provided with such a sole 14. In all variants shown in FIGS. 5 to 9, an upper edge 14*a* of the sole 14 ends beneath the lower end of the corresponding air passage opening 20.

In a manner not shown, especially in the case of walking or hiking shoes, a rubber strip serving mostly as pebble protection can be applied to the area of the outer shaft material 16 situated directly above the upper edge 14*a* of the sole 14, i.e., where the at least one passage opening 20 is situated, for example by gluing to the outer shaft material 16 and the upper edge 14*a* of the sole, which has the same color as the sole 14, for example. In order to avoid blocking the air permeability of the air passage openings 20, the rubber edge on the air passage openings 20 is provided in turn with air passage opening at corresponding sites.

In all variants of FIGS. 5 to 9, the air passage openings 20 are provided with an air-permeable protective covering 22, which is formed, for example, by a gauze or mesh made of metal or plastic or by a textile material with high air permeability and therefore also high water vapor permeability. The protective covering 22 can be situated on the outside (FIGS. 5, 6, 8, and 9) or inside (FIG. 7) of the corresponding air passage opening 20. Either each air passage opening 20 has its own protective covering 22 applied or a common protective covering strip is applied to some of the air passage openings 20 or all air passage openings 20, which strip extends over the corresponding number of air passage openings 20.

FIGS. 5 to 9 will now be considered in additional detail.

In the variant according to FIG. 5, the functional layer on the inside of the outer shaft material 16 and the functional layer on the top of the air-permeable layer 40 are both part of a sock-like bootie 39 that lines the entire shaft arrangement 12 on its inside, except for the foot-insertion opening 12*a*. Such a bootie is usually stitched together from several functional layer parts, wherein the stitching sites are glued over with a watertight seam-sealing strip and made watertight in this way. However, the bootie could also be produced from one piece of material, which would then no longer entail the need for sewing together and sealing. In the embodiment shown in FIG. 5, the bootie is constructed with the already mentioned functional layer laminate 24. The shaft arrangement 12 is therefore waterproof, and after addition of a sole 14, a waterproof shoe is present. The air-permeable layer 40 is arranged in the shaft bottom area directly beneath the functional layer laminate 24 of the bootie 39. The air-permeable layer 40 then extends over the entire shaft bottom area, and the entire foot sole is then available for water vapor exchange and heat exchange. Beneath the air-permeable layer 40 the inlay sole 40 is situated, on the bottom of which the last insert 16*a* of the lower end area on the sole side is attached by means of lasting glue (not shown). Instead of using a separate inlay sole, it is also possible in certain variants to make the bottom or lower support surface of the air-permeable layer 40 correspondingly stable, so that the last insert can be attached to this bottom. In such an embodiment, the air-permeable layer additionally assumes the function of an inlay sole.

In the variant according to FIG. 6, separate functional layers 37 and 38, which belong to the shaft functional layer laminate 27 and the shaft bottom functional layer laminate 28, respectively, are situated on the inside of outer material 16 and in the area of shaft bottom 15. An inserted lower end area 27*a* of the shaft functional layer laminate 27 on the sole side is firmly stitched to the inlay sole 30 by mean of a Strobel seam 32. The shaft bottom functional layer laminate 28 is situated beneath the inlay sole 30 and extends to beneath the inserted end area 27*a* of the shaft functional layer laminate 27 and is joined in a waterproof manner to the end area 27*a* by means of a sealing material (not shown), for example, in the form of a sealing glue, so that the shoe interior is waterproof all around because of the cooperation of the functional layers 37 and 38, which are sealed with respect to each other, with the exception of the foot-insertion opening 12*a* and the lace area 12*b* of the shoe 10, as when a functional layer bootie is used. It is also possible to connect the shaft bottom functional layer above the inlay sole to the shaft functional layer laminate in a waterproof manner. Since the shaft bottom functional layer 38 extends to beneath the inserted end area 27*a* and thereby beyond the Strobel seam 32, the Strobel seam 32 is also sealed from the shaft bottom functional layer 38. The air-permeable layer 40 is arranged directly beneath the shaft bottom functional layer laminate 28. The last insert 16*a* of the outer material 16 is attached to the bottom or lower support surface of the air-permeable layer 40 by means of a lasting glue (not shown). The air-permeable layer therefore additionally assumes the function of an inlay sole. In principle, however, it would also be possible to provide a separate inlay sole beneath the air-permeable layer. Unevenness on the bottom of the shaft bottom 15 caused by the last insert 16*a* of the outer material 16 is compensated by the filler layer 31, in the manner already mentioned.

The variant shown in FIG. 7 differs from the variant shown in FIG. 6 only in that the protective covering 22 is not arranged on the outside, but on the inside of the outer shaft material 16, directly along the peripheral side surfaces 42 of the air-permeable layer 40 and on the inside, in front of the air passage opening 20.

The variant shown in FIG. 8 differs from the variants according to FIGS. 5 to 7, on the one hand, in that the outer material 16 is provided only with a liner layer 18, but not with a shaft functional layer, except for a lower area close to the shaft bottom 15 and, on the other hand, by the fact that two inlay soles and two Strobel seams are present. The liner layer 18 has a liner layer insert 18*a* on a lower end on the sole side, which insert is joined to an inlay sole 30 by means of a Strobel seam 32. The lower end area 16*a* of the outer shaft material 16 on the sole side is connected by means of an additional Strobel seam 33 to an additional inlay sole 30*a*. The shaft bottom functional layer 38, which can again be part of the shaft bottom functional layer laminate, has an upward protruding collar 38*a* on its outer periphery that extends into a gap between the outer material 16 and the liner layer 18. The air-permeable layer 40 is arranged between the shaft bottom functional layer 38 or the shaft bottom functional layer laminate and the additional inlay sole 30*a*. The shaft bottom functional layer laminate can also be arranged above the inlay sole.

However, the upper shaft area in the variant according to FIG. 8 is not waterproof. The shoe according to FIG. 8 is therefore particularly suitable for a use where wetness from the top is less of a concern than wetness from the bottom and from the side, i.e., for walking or hiking in moist surroundings, when it is not raining or when one is standing for only a shorter time in the rain.

Figure 9:
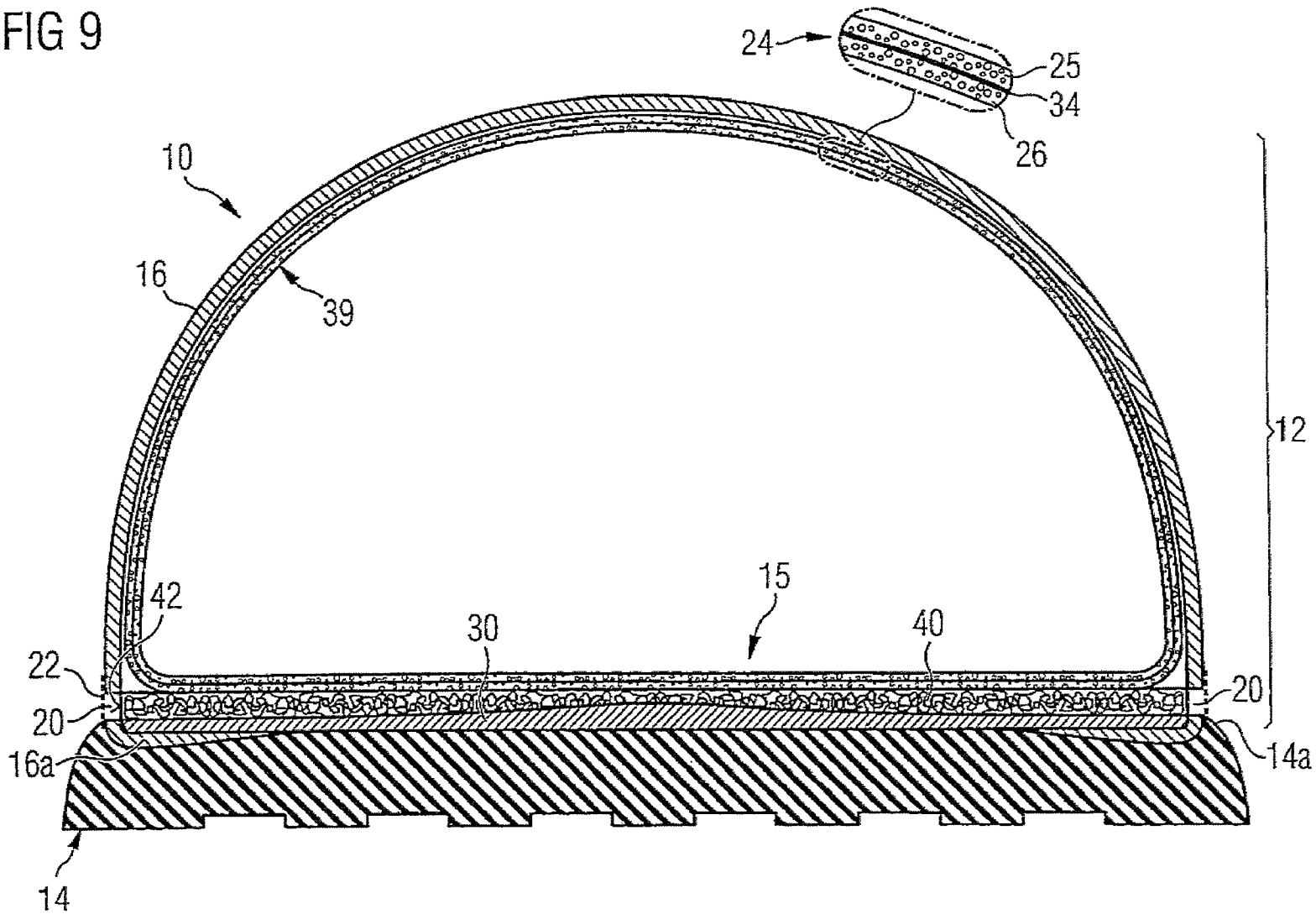
FIG. 9 shows a schematic view of a cross-section through part of the forefoot area of a shoe designed according to one of the variants shown in FIGS. 1 to 4, in a fifth variant of its shaft arrangement.

The variant shown in FIG. 9 essentially corresponds to the variant shown in FIG. 5. In contrast to FIG. 5, the inlay sole 30 is configured such that the surface of the inlay sole 30 directed toward the air-permeable layer 40 is raised in the center at an angle and protrudes into the air-permeable layer. The lower support surface of the air-permeable layer 40 is therefore raised or pressed according to the angular elevation of the inlay sole 30. As a result of this, two sloped planes are formed within the air-permeable layer, which run downward from the center in the direction of the peripheral side surfaces 42 and thus facilitate runoff of any water present in the air-permeable layer 40. Such a configuration of the inlay sole 30 can also be provided for the variants in FIGS. 5 to 8.

Figure 10:
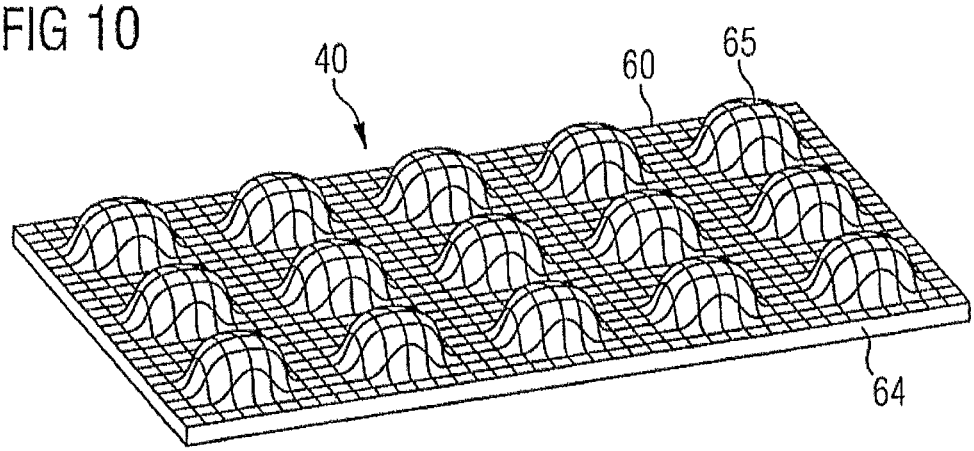
FIG. 10 shows a first variant of an air-permeable layer usable for a shoe designed according to DE 10 2008 027 856.
Figure 11:
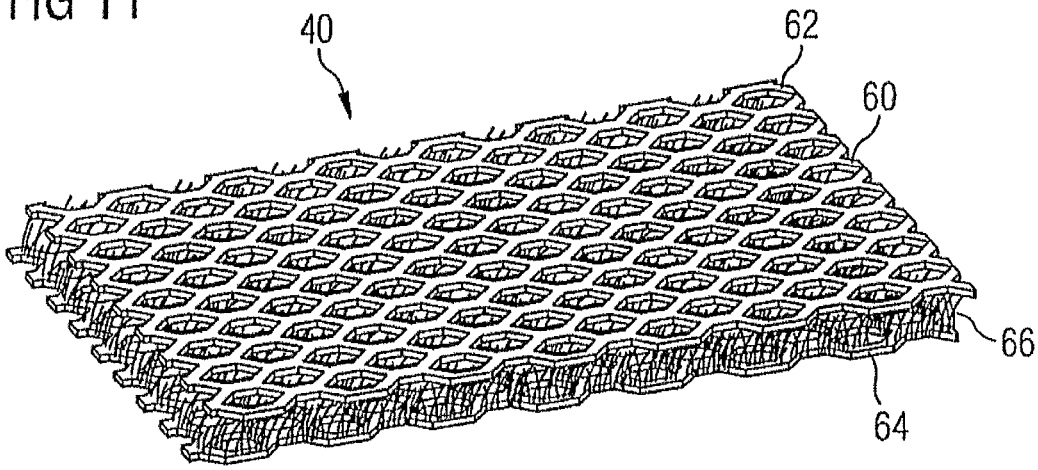
FIG. 11 shows a second variant of an air-permeable layer usable for a shoe designed according to DE 10 2008 027 856.
Figure 12:
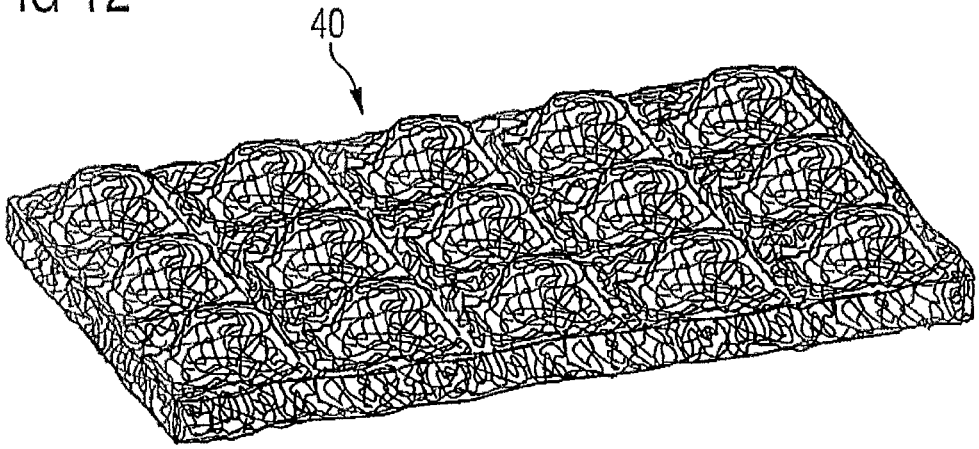
FIG. 12 shows a third variant of an air-permeable layer usable for a shoe designed according to DE 10 2008 027 856.
Figure 13:
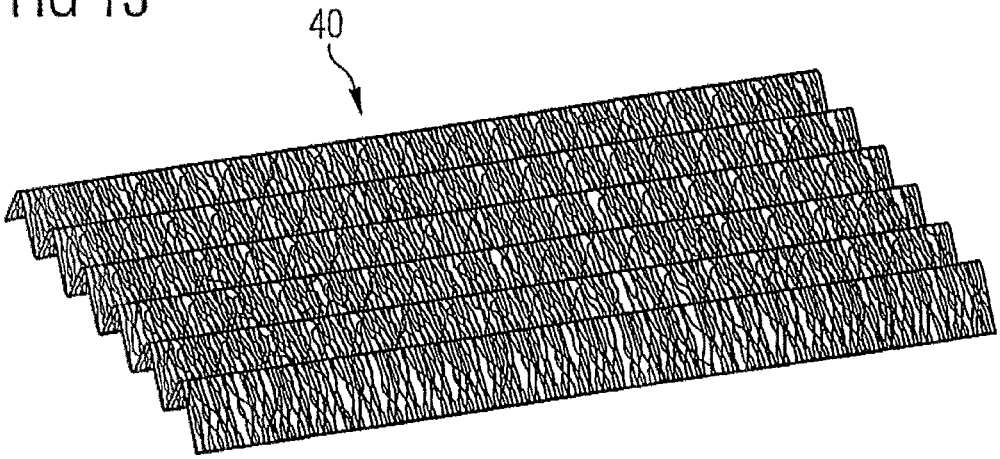
FIG. 13 shows a fourth variant of an air-permeable layer usable for a shoe designed according to DE 10 2008 027 856.
Figure 14:
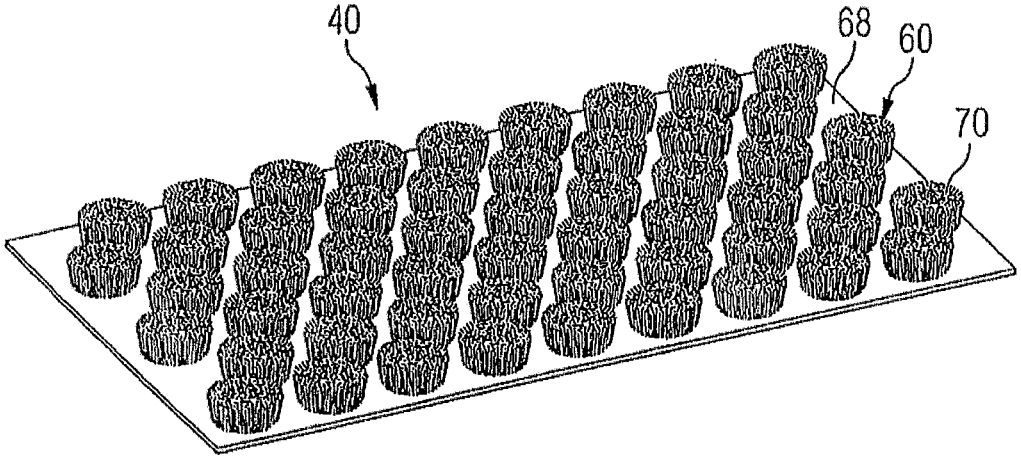
FIG. 14 shows a fifth variant of an air-permeable layer usable for a shoe designed according to DE 10 2008 027 856.

Different variants of spacer structures 60 are shown as examples in FIGS. 10 to 14, which are suitable for the air-permeable layer 40. All these spacer structures have the common feature that they form two support surfaces spaced from each other, wherein the spacer structure lies with the lower support surface on the corresponding substrate and its upper support surface serves as a support surface for the layer situated above the spacer structure, which can be the bottom area of the functional layer bootie (FIG. 5 or 9) or the shaft bottom functional laminate (FIGS. 6 to 8). The two support surfaces are either both formed by a flat structure, and are held at a spacing from each other by means of spacers situated between them, at least the upper one of which is air permeable (FIG. 11), or only the lower support surface is formed by a flat structure, from which spacer elements protrude, the free ends of which form support points that together have the function of the upper support surface (FIGS. 10, 12, and 14). Or else there is neither a lower nor an upper flat structure, but a single flat structure which is brought into a corrugated or zigzag form with lower and upper wave or tooth crests that define the lower or upper support surface (FIG. 13).

The spacer structures shown in FIGS. 10 to 14 will now be considered in more detail.

In the variant shown in FIG. 10 of a spacer structure 60 appropriate as an air-permeable layer 40, roughly hemispherical protrusions or bulges 65 bulge upward from a lower flat structure 64, whose upper crests define an upper support surface. In one variant, this spacer structure 60 consists of an initially flat knit or solid material which, after it has been brought to the form shown, is stiff or stiffened by a deep-drawing process, for example, such that it retains this shape even under the stress to which it is exposed during walking with the shoe equipped with this spacer structure. In addition to a deep-drawing process, other steps already mentioned can also be used, namely deformation and stiffening by a thermoforming process or impregnation with a synthetic resin that cures to the desired form and stiffness.

FIG. 11 shows an embodiment example for a spacer structure 60 suitable as an air-permeable layer 40, whose upper and lower support surfaces are formed by two parallel air-permeable flat structures 62 and 64 that are chosen, for example, from the group of polyolefins, polyamides, and polyesters, wherein the flat structures 62 and 64 are joined to each other in an air-permeable manner by support fibers 66 and are simultaneously spaced. At least some of the fibers 66 are arranged as spacers, at least roughly perpendicular, between the flat structures 62 and 64. The fibers 66 are made of a flexible, deformable material, such as polyester or polypropylene. Air can flow through the flat structures 62 and 64 and between the fibers 66. The flat structures 62 and 64 are of open-pore woven, warp-knit, or knit textile materials. Such a spacer structure 60 can be the already mentioned spacer knit available from the Tylex Co. or the Müller Textile Co.

The spacer structure 60 shown in FIG. 12 has a structure similar to the spacer structure shown in FIG. 10, but it consists of a knit of knit fibers or knit filaments that is brought into this form and consolidated in this form by a thermal process or impregnation with synthetic resin.

FIG. 13 shows a variant of a spacer structure 60 with a zigzag or a sawtooth profile, to which an initially flat material has been shaped, such that the upper and lower crests 60*a* and 60*b* define the upper and lower support surface of this spacer structure 60. The spacer structure 60 of this form can also be formed by the already mentioned methods and reinforced to the desired stiffness.

FIG. 14 shows another embodiment example of a spacer structure 60 suitable as an air-permeable layer 40. In this variant, spacer elements are formed not by protrusions or bulges from the single lower flat structure 68, but by fiber bundles 70 that protrude upward from the flat structure 68 and whose upper free ends together define the upper support surface. The fiber bundle 70 can then be applied by flocking the lower flat structure 68.

Figure 15:
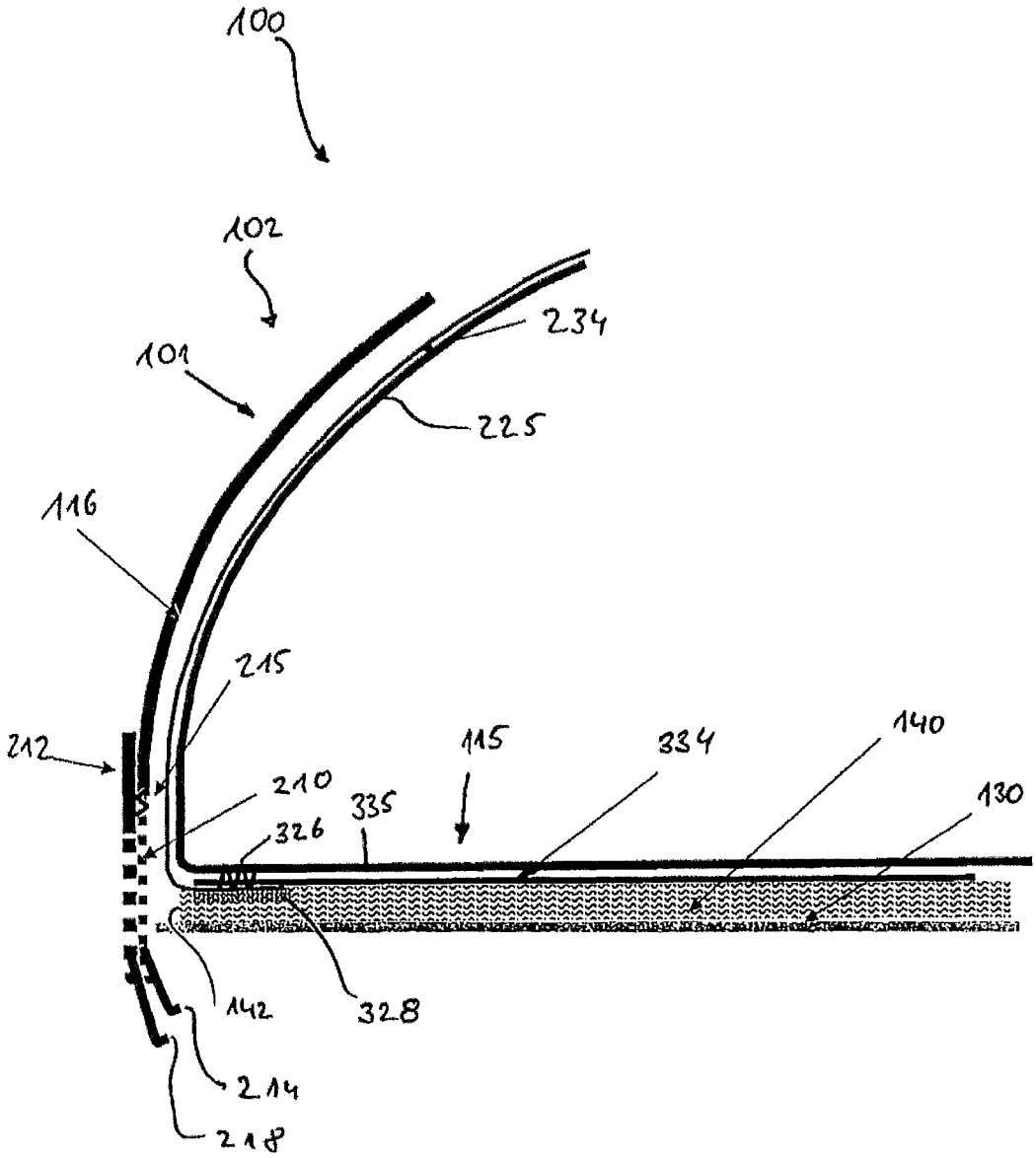
FIG. 15 shows a first variant of footwear designed according to the invention in a partial sectional view before a lasting process.
Figure 16:
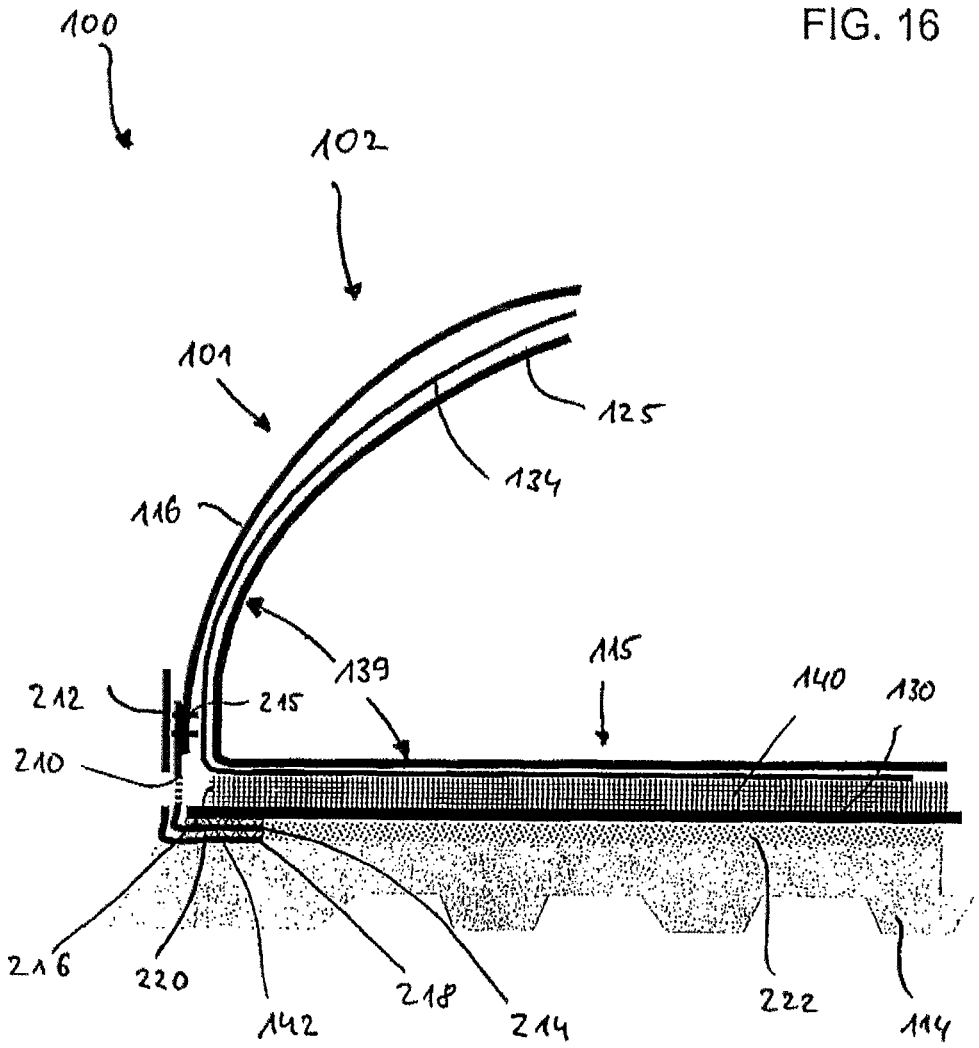
FIG. 16 shows a second variant of footwear designed according to the invention, similar to the first variant of FIG. 15, after a lasting process and the application of an outsole.
Figure 17:
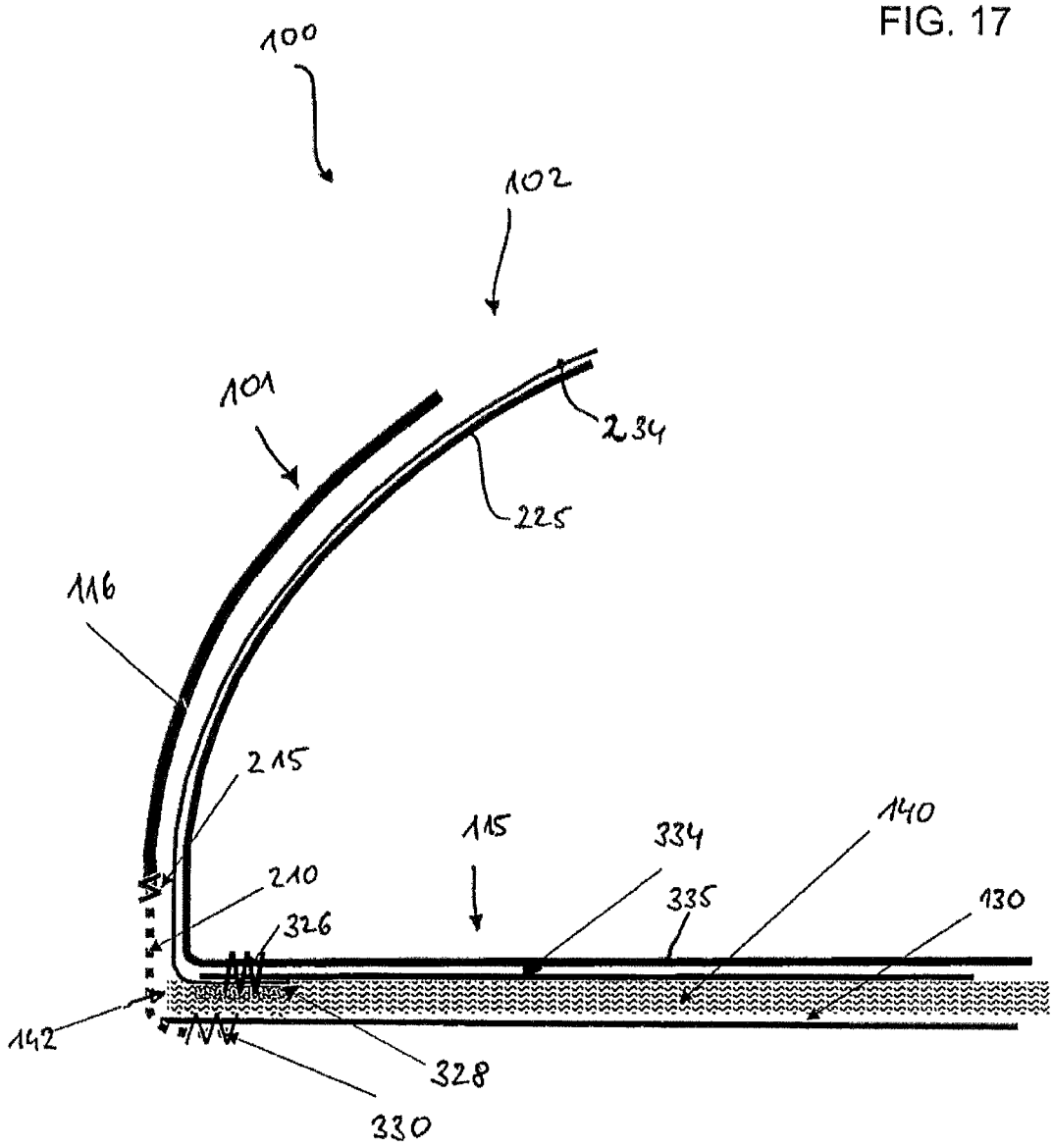
FIG. 17 shows a third variant of footwear designed according to the invention in a partial sectional view with a Strobel seam shaft arrangement.
Figure 18:
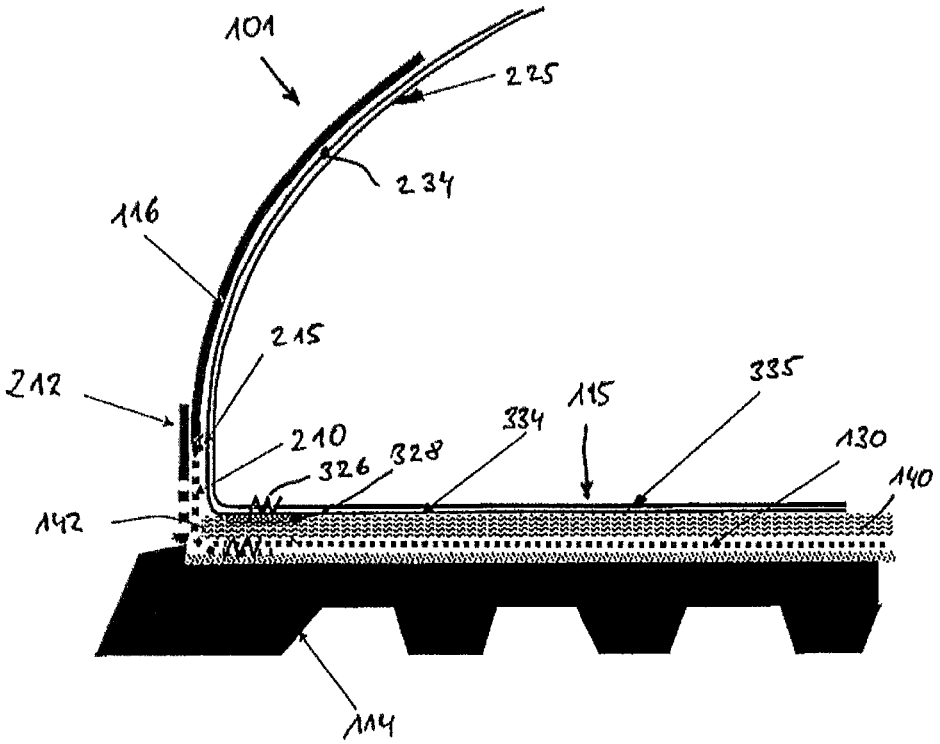
FIG. 18 shows the footwear depicted in FIG. 17 after the application of an outsole.

Variants of footwear according to the invention and/or its components will now be considered and explained with reference to FIGS. 15 to 24. FIGS. 15 and 16 show variants of the lasted version before and after the lasting process, FIGS. 17 and 18 show a variant of the Strobel version and FIG. 19 again shows a variant of the lasted version.

Although only the lasting and Strobel seam versions are considered in the following variants, the invention is in no case restricted to these, but is also applicable to all other versions.

In the figures explained below the same reference numbers are used for the same elements and features, even when the embodiment examples involve different versions.

When terms such as top, bottom, above, beneath, vertical, horizontal and so forth are used, this refers to the specific figure and is not to be taken absolutely.

FIG. 15 shows a partial structure of a first, lasted variant of footwear 100 according to the invention in a partial sectional view in the forefoot area in a stage of production before a lower end area of a shaft 101 on the sole side is lasted to the bottom of a peripheral area of an inlay sole 130, often also called the insole.

This footwear 100 has a shaft arrangement 102 with shaft 101 and a shaft bottom 115, with which the lower area of the shaft 101 on the sole side is closed.

The shaft 101 has an outer material 116 and a shaft functional layer 234 on the inside thereof, and, in the depicted variant, a shaft liner 225 on the inside thereof. The shaft bottom 115 has a shaft bottom functional layer 334 and, in the depicted variant, a shaft bottom liner 335 on the top thereof. In the area of the outer periphery of the shaft bottom 115, the shaft functional layer 234 and the shaft bottom functional layer 334, on the one hand, and the shaft liner 225 and the shaft bottom liner 335, on the other hand, are connected to each other by a shared Strobel seam 326. In order to seal the connection transition between the shaft functional layer 234 and the shaft bottom functional layer 334 at this stitching site, a sealing material 328 is situated in the area of the Strobel seam 326 beneath the shaft bottom functional layer 334 and a lower end area of the shaft functional layer 234, inserted to the shaft bottom 115. An air-permeable layer 140, beneath which the inlay sole 130 is situated, is arranged beneath the shaft bottom functional layer 334.

The actual outer material 116 ends at a spacing above the air-permeable layer 140 where it is lengthened with a connection material 210, which is connected to the shaft outer material 116 by means of a seam 215 and which in the production stage depicted in FIG. 15 hangs downward and is embodied as air-permeable in an area between the seam 215 and the bottom of inlay sole 130 in order to permit air exchange between a peripheral side surface 142 of the air-permeable layer 140 and the outside of the footwear 100 at the level of the air-permeable layer 140 in the finished footwear 100. The lower end area of the connection material 210 lying away from seam 215 hangs downward above the inlay sole 130 far enough that it can serve as a connection material lasting edge 214 in a subsequent lasting process. On the outside of the connection material 210 a cover strip 212 is situated, whose upper end area covers seam 215 and therefore does not allow this seam 215 to be visible in the finished footwear 100. A lower end area of the cover strip 212 also hangs downward over the plane of the inlay sole 130 such that its lower end area can serve as a cover strip lasting edge 218 in a subsequent lasting process. In an area situated at the level of the air-permeable layer 140, the cover strip 212 is also embodied as air permeable in order to permit air exchange between the air-permeable layer 140 and the outside of the cover strip 212.

In the depicted variant the connection material 210 and the cover strip 212 have air-permeable regions whose vertical extension goes beyond the top and the bottom of the air-permeable layer 140. As a result, not only is a particularly effective air exchange guaranteed between the air-permeable layer 140 and the outside of the footwear 100, but it is also ensured that even with tolerance-related vertical positioning differences of the connection material 210 and/or the cover strip 212 relative to the air-permeable layer 140, air-permeable regions of the connection material 210 and the cover strip 212 are always located at the level of the air-permeable layer 140. In the areas in which the air-permeable regions of the cover strip come to lie in the area of the shaft, this further increases the climate comfort of the shoe, since the water vapor-impermeable shaft cover is partially removed. For the desired air exchange between air-permeable layer 140 and the outside of footwear 100, however, it is sufficient for the connection material 210 and the cover strip 212 to be embodied as air-permeable only in the thickness area of the air-permeable layer 140, wherein it may even be sufficient for these air-permeable regions of the connection material 210 and cover strip 212 to extend only over a partial area of the thickness of the air-permeable layer 140.

An example in which both the connection material 210 and the cover strip 212 are embodied as air permeable in the vertical area corresponding only roughly to the thickness of the air-permeable layer 140 is shown by a second, also lasted variant of the invention depicted in FIG. 16.

FIG. 16 also shows a partial sectional view in the forefoot area of footwear 100 with the partial structure similar to that of FIG. 15, but after the process of lasting the lower end area of the shaft 101 on the sole side onto the bottom of the inlay sole 130, and after the application of a sole 114, also called the outsole, which in the depicted variant is an outer sole. In contrast to the variant depicted in FIG. 15, the shaft functional layer and the shaft bottom functional layer are part of a functional layer bootie 134, i.e., a sock-like functional layer insert. In the same manner, the liner prescribed in this variant consists of a liner bootie 125, which has a shaft liner area and a shaft bottom liner area. The functional layer bootie 134 and the linear bootie 125 can usually each be a part of a functional layer laminate bootie 139.

Otherwise the variants of FIGS. 15 and 16 are the same.

FIG. 16 shows that in this variant both the connection material 210, which can be embodied as mesh-like or lattice-like at least in the air-permeable region, and the cover strip 212 are lasted onto the bottom of the inlay sole 130. In the variant depicted in FIG. 16, a connection material last insert 214 is first lasted in a first lasting process by means of a connection material lasting glue 216 onto the bottom of inlay sole 130. In a subsequent, second lasting process a cover strip last insert 218 is then lasted onto the bottom of the connection material last insert 214 by means of a cover strip lasting glue 220.

It is also possible to connect the connection material last insert 214 and the cover strip last insert 218 to each other before the lasting process and to fasten them to the bottom of the inlay sole 130 in a single lasting process by means of a single layer of lasting glue.

As shown in FIGS. 15 and 16, the actual outer material 116 stops above the air-permeable layer 114 so that the peripheral side surface 142 of the air-permeable layer 140 remains uncovered by the outer material 116. The fastening site, for example a stitching site formed by a seam 215, between the outer material 116 and the connection material 210 is also situated above the air-permeable layer 140. Since the connection material 210 is embodied as air permeable at least in the area in which it lies opposite the peripheral side surface 142 of the air-permeable layer 140, largely unhampered air exchange is made possible between the air-permeable layer 140 and the outside of the connection material 210.

The cover strip 212, for example in the form of a band of rubber of rubber-like material, is embodied as air permeable at least in the area that lies at the level of the peripheral side surface 142 of the air-permeable layer 140, so that a largely unhampered air exchange can occur between the air-permeable layer 140 and the outside of the cover strip 212.

In the variant depicted in FIG. 16 the cover strip 212 on its upper longitudinal side (seen in FIG. 16) has an overhang over the fastening area (seam 215) between connection material 210 and outer material 116, so that this fastening area is covered by the cover strip 212. The cover strip 212 in this area therefore serves, on the one hand, to keep this fastening area invisible in the finished footwear and, on the other hand, to protect this fastening area from mechanical damage. If in one variant the connection between outer material 116 and connection material 210 occurs by means of the seam 215 shown in FIG. 16, which has a certain sensitivity to mechanical friction and whetting, the reliability and service life of the footwear 100 is significantly improved by covering the seam 215 by the cover strip 212.

Because of the last inserts 214 and 218, a step forms on the bottom of the peripheral area of the inlay sole 130, which would lead to a cavity between inlay sole 130 and the sole 114 that is applied later beneath the inlay sole 130. In order to avoid such a cavity, a filler layer 222 is applied to a middle area of the inlay sole bottom, which filler layer is situated within the last inserts 214 and 218. When, after production of the shaft arrangement 102, whose shaft bottom 115 has, from the top downward (viewed in FIG. 16), the shaft bottom area of functional layer 134, the air-permeable layer 140, the inlay sole 130 and the filler layer 222, and optionally, as in the variant depicted in FIG. 16, a textile layer 125 serving especially as a liner on the inside of functional layer 134, the sole 114 is also applied, in the case of the variant in FIG. 16 in the form of an outsole, then because of the filler layer 222 said sole will lie on an essentially flat bottom of the shaft bottom 115. The sole 114 can be a sole that is glued onto the shaft bottom 115 or a sole that is molded onto the shaft bottom 115. Both sole types are equally suited for the footwear 100 according to the invention.

FIGS. 17 and 18 show a third variant of footwear according to the invention, which largely agrees with the first variant depicted in FIG. 15 with respect to the formation of the shaft arrangement 102. It deviates to the extent that in the third variant according to FIGS. 17 and 18, on the one hand, the lower end area of the connection material 210 is connected to the inlay sole 130 by means of a seam 330, which can be a Strobel seam, and on the other hand, the lower end area of cover strip 212 does not emerge in a horizontal insert, as in the variants of FIGS. 15 and 16, but extends completely vertically. As shown in FIG. 18, which shows the shoe structure, once the partial structure according to FIG. 17 has been provided with the sole 114 and the cover strip 212, the cover strip 212 extends on its lower end in vertical alignment up to the upper edge of the sole 114. In this variant the cover strip 212 can be applied after the sole 114 has been fastened to the shaft bottom 115, either by gluing to shaft bottom 115 or by molding onto shaft bottom 115.

Figure 19:
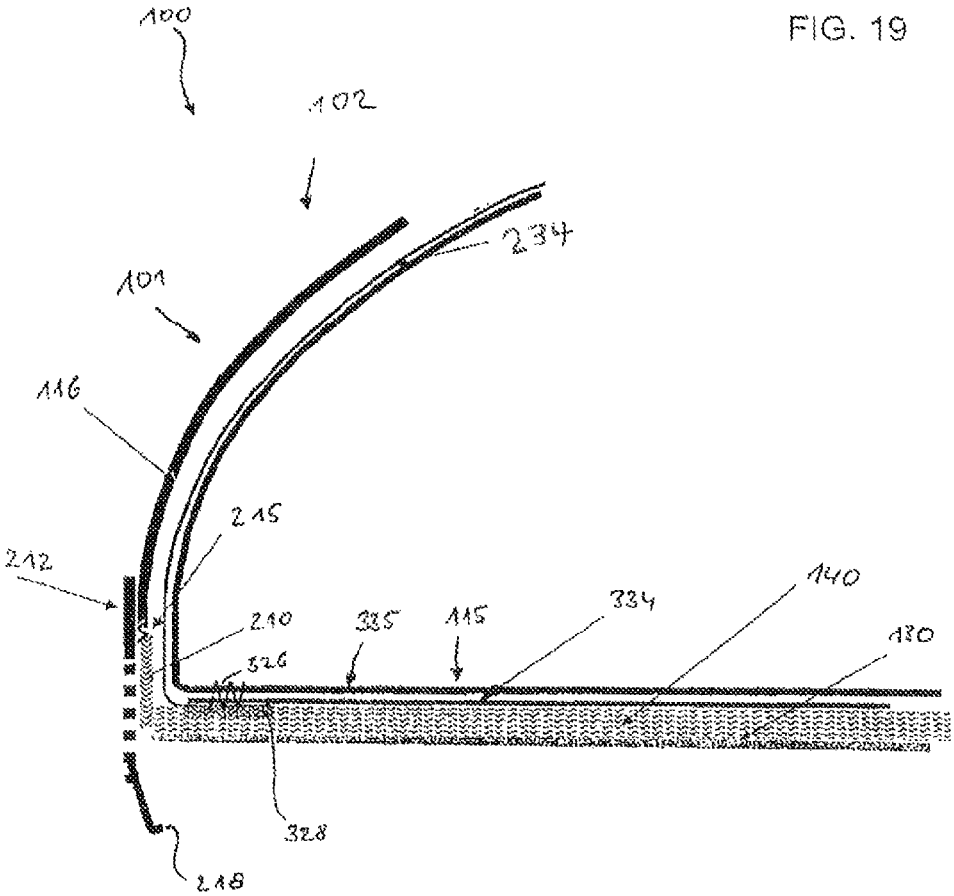
FIG. 19 shows a fourth variant of footwear designed according to the invention in a partial sectional view with an air-permeable layer connected to the shaft outer material, before application of the sole.

FIG. 19 shows a fourth, lasted variant of footwear 100 according to the invention before the processes of lasting and application of a sole 114 have been carried out, which are not shown for this variant but can be conducted according to FIG. 16. This fourth variant largely agrees with the first variant according to FIG. 15 with respect to the shaft and shaft bottom structure. Deviation relative to FIG. 15 exists to the extent that the connection material 210 is material of the air-permeable layer 130, which protrudes vertically upward from the peripheral edge of the air-permeable layer 140 and is connected by seam 315 to the lower end of outer material 116. Deviating from FIGS. 15 and 16, in the fourth variant according to FIG. 19 only a single lasting process is necessary, namely fastening the cover strip last insert 218 to the bottom of the inlay sole 130 by lasting. In particular, when the cover strip 212 is embodied as air permeable over a large part of its vertical extension between seam 215 and inlay sole 130, a large-area air exchange with the outside of the footwear 100 can occur via the connection material 210 formed by the material of air-permeable layer 140.

For all the previously described variants it applies that the connection material 210 and the cover strip 212 begin at least above a bottom of the air-permeable layer 140 and are air permeable in the vertical area extending at least over a partial area of the thickness of air-permeable layer 140.

Figure 20:
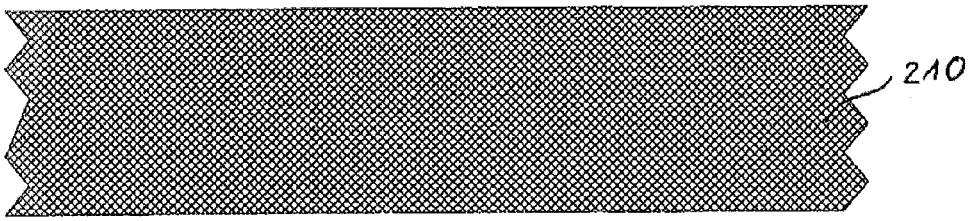
FIG. 20 shows a plan view of part of a first variant of a connection material according to the invention for footwear according to the invention.
Figure 21:
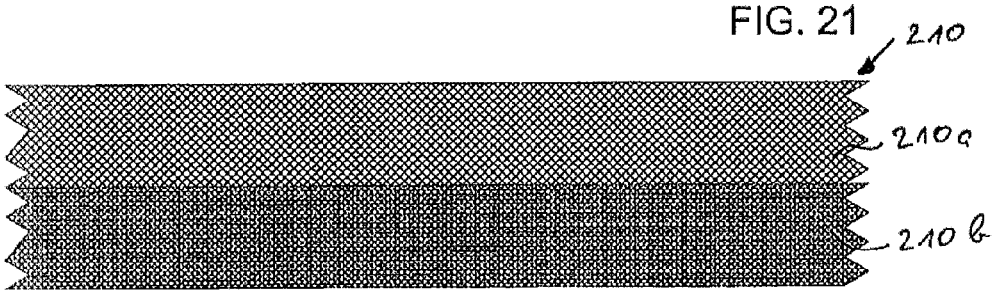
FIG. 21 shows a plan view of part of a second variant of a connection material according to the invention for footwear according to the invention.

Two embodiment examples for a connection material 210 suitable for footwear 100 according to the invention are shown in FIGS. 20 and 21. In both figures it is indicated based on the lateral outlines that only a section of a connection material is involved, which actually has a greater length.

FIG. 20 schematically depicts a first embodiment example in which the connection material 210 is formed from a mesh-like or latticed material and has the same opening size over its entire width extent, i.e., has the same air permeability per unit of surface over its entire length and width extent.

FIG. 21 schematically depicts a second embodiment example in which the opening size of the connection material 210 is greater in an upper part 210*a* of its width extent than in the remaining lower part 210*b* of its width extent in order to create a particularly good adaptation to the different requirements in the upper part 210*a* of its width extent and in the lower part 210*b* of its width extent. Owing to the greater opening size in the upper part 210*a* of the width extent, a higher air permeability is achieved wherever this connection material 210 is opposite the peripheral side surface 142 of the air-permeable layer 140 than in the lower part 210*b* of the width extent with the smaller opening size, which forms at least partly the connection material insert 214 and is intended to have a particularly high mechanical loadability there in order to be able to tolerate the lasting forces or other fastening forces particularly well. However, it is also possible to construct only the upper part 210*a* of the width extent of the connection material 210 with air-permeable material, for example in the form of a latticed material, mesh-like material, textile mesh or by material made air-permeable by perforations, whereas the lower part 210*b* of the width extent of connection material 210 is constructed with a material without air permeability but with particularly high fastening force loadability.

Figure 22:
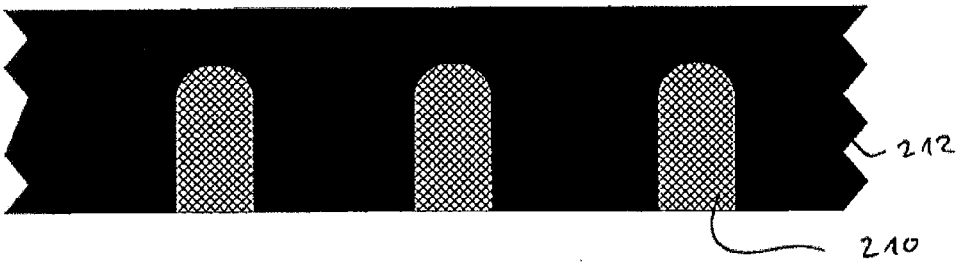
FIG. 22 shows a plan view of part of a first variant of a cover strip according to the invention for footwear according to the invention.
Figure 23:
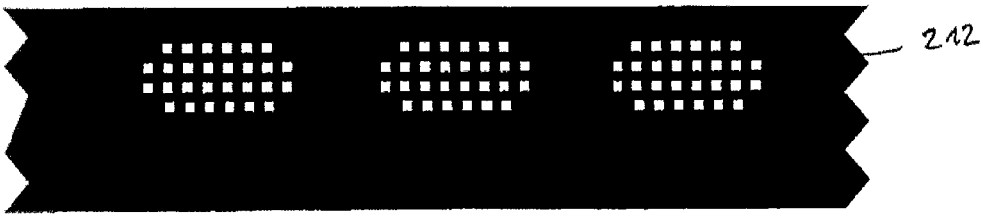
FIG. 23 shows a plan view of part of a second variant of a cover strip according to the invention for footwear according to the invention.

FIGS. 22 and 23 show embodiment examples for the cover strips 212 suitable for the footwear 100 according to the invention. In this case as well it is indicated by lateral outlines that the depiction involves only a partial section of the corresponding cover strip.

In order to produce a particularly high mechanical protective function for the lower area of the shaft 101, i.e., where a walking shoe, for example, also called a hiking shoe, which is supposed to be particularly suited for mountain walking, is exposed to particularly high impact, friction and whetting loads, preferably a particularly robust material, for example, in the form of a band of rubber, rubber-like plastic or robust textiles whose robustness is improved for example, by coating the textile or the rubber-like mass, can be used for the cover strips 212.

Another possibility involves constructing the cover strip 212 with an air-permeable material in order to ensure in the finished footwear at the level of the air-permeable layer 140 the desired air permeability of the air-permeable layer 140 to the outside of the cover strip 212. In the variants depicted in FIGS. 22 and 23 the cover strip 212 is constructed with a naturally air-permeable material, which can be embodied as particularly robust, and passage openings that permit the desired air permeability are formed in that area of the cover strip 212 that lies opposite the air-permeable layer 140 in the finished footwear.

In the variant depicted in FIG. 22 the cover strip 212 in its longitudinal extension has recesses 213 spaced from each other, which extend to the lower longitudinal edge of the cover strip 212 so that the cover strip 212 at these locations is open downward. The connection material 210 extends behind the recesses.

In the case of the variant depicted in FIG. 23 the cover strip 212 in its longitudinal extension is formed in areas that are spaced from each other by corresponding perforations with lattice zones 217, which permit the desired air permeability at the required locations. In this variant the partial area of the cover strip 212 situated beneath the lattice zones 217 remains unweakened, i.e., in the area that forms the cover strip last insert 218, so that a cover strip 212 of the variant depicted in FIG. 23 is particularly suitable to take up the forces occurring during a lasting process or other fastening process. In addition, the lower area of the cover strip 212 according to FIG. 20 can be better grasped with the lasting tongs used for lasting than the cover strips 212 according to FIG. 19, which have gaps 213 in the lower area, especially if lasting tongs are used that only grip a relatively small longitudinal area of the cover strip 212.

The variant in FIG. 23 can also be embodied such that the openings are arranged uniformly over the entire surface and over the entire width and length of the cover strip 212.

Figure 24:
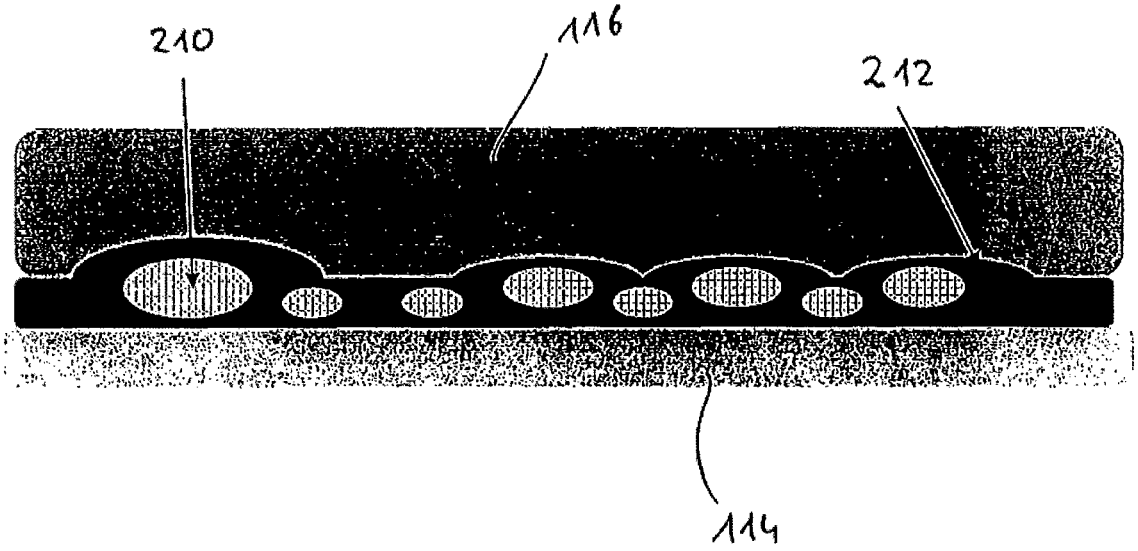
FIG. 24 shows a plan view of part of a third variant of a connection material according to the invention in the form of a composite made of rubber band and lattice band.

FIG. 24 shows as a configuration example a side plan view of part of the footwear 100 according to the invention, wherein at the top the outer material 116 of shaft 101 is shown, on the bottom part of the sole 114 is shown, and in between the cover strip 212 and its air passage openings, which in this case are mesh-like or lattice-like connection material 210, are shown.

Information now follows concerning the structure, material, and properties for the connection materials which are particularly suitable for the footwear according to the invention.

| | |
|---|---|
| Structure: | Mesh or lattice |
| Material: | Plastic in which especially PA (polyamide) and PES (polyester) are suitable<br>Alternative: TPU (thermoplastic polyurethane), SAN (styrene-acrylonitrile copolymers), ABS (acrylonitrile-butadiene-styrene), PP (polypropylene) |
| Thickness: | suitable: 0.3 mm to 3 mm<br>preferred: 0.5 mm to 2 mm<br>especially preferred: 1.4 m to 1.8 mm |
| Width: | Must amount to at least part of the thickness, preferably equal to or greater than the thickness of the air-permeable layer |
| Basis weight: | suitable: 50-1000 g/m$^2$<br>preferred: 200-700 g/m$^2$<br>for example: a) the product KIWI (484 g/m$^2$) from Panatex s.r.l., Prato, Italy<br>b) article 1517 from Acker Textilwerke GmbH, Seligenstadt, Germany |

-continued

| | |
|---|---|
| Shape of the air passage openings: | any |
| Size of the air passage openings: | suitable: 0.1-10 mm<br>preferred: 0.5 mm to 5 mm |
| Surface ratio of air permeability openings: | greater than 10% of the total surface<br>preferably greater than 30% of the total surface |
| Air permeability (measured according to DIN ISO 9237:1995): | suitable: 100-8000 L/m$^2$s at 100 Pa pressure difference<br>preferred: 1000-5000 L/m$^2$s at 100 Pa pressure difference<br>1500-5000 L/m$^2$s at 100 Pa pressure difference<br>2000-5000 L/m$^2$s at 100 Pa pressure difference |
| Mechanical properties: | The strength and elongation were determined using the example of the material KIWI from Panatex s.r.l. according to ISO 13934.1 (02/99) on the Instron test instrument:<br>1$^{st}$ measurement in the transverse direction: at 150N tensile force, elongation (%): 3.2%<br>2$^{nd}$ measurement in the diagonal direction: at 150N tensile force, elongation (%): 12.5%<br>3$^{rd}$ measurement in the longitudinal direction: at 150N tensile force, elongation (%): 53% |

The invention claimed is:

1. Footwear with shaft comprising a shaft arrangement and a sole, in which the shaft arrangement comprises (1) a shaft outer material comprising a peripheral extension, (2) a shaft bottom, (3) an air-permeable layer arranged in the shaft bottom, wherein the air-permeable layer is arranged in a lower area of the shaft arrangement on the sole side of the shaft arrangement above the sole, wherein the air-permeable layer has a three-dimensional structure that permits air passage at least in the horizontal direction; and (4) a lower peripheral area of the shaft outer material on the sole side over at least part of its peripheral extension comprising at least one connection material which is arranged beginning at least above the bottom of the air-permeable layer and running outside the air-permeable layer and on the shaft bottom, said connection material being air permeable at least in a partial area situated at least partially at the same level as the air-permeable layer, thereby connecting the air-permeable layer with the outer surroundings such that air can be exchanged between the outer surroundings and the air-permeable layer, in which a cover strip, which extends over an upper end of the connection material to the shaft outer material and is air permeable at least in part of the area that is situated at least partially at the level of the air-permeable layer, is on at least part of the outside of the shaft.

2. Footwear according to claim 1, in which the connection material is formed from a composite having the lattice or mesh band and the cover strip.

3. Footwear according to claim 1, in which the lower part of the cover strip is fastened beneath the air-permeable layer.

4. Footwear according to claim 1, which has a water vapor-permeable functional layer, at least in a lower area of the shaft arrangement that faces the sole, wherein the air-permeable layer is arranged beneath the functional layer.

5. Footwear according to claim 4, in which the functional layer is waterproof.

6. Footwear according to claim 4, with a shaft functional layer and a shaft bottom functional layer.

7. Footwear according to claim 4, with a sock-like functional layer bootie, in which a shaft area is formed at least partially by the shaft functional layer, and a shaft bottom area is formed by the shaft bottom functional layer.

8. Footwear according to claim 4, in which the functional layer of the shaft functional layer and/or the shaft bottom functional layer is part of an at least two-layer laminate.

9. Footwear according to claim 8, in which the laminate is a shaft bottom functional layer laminate and/or a shaft functional layer laminate.

10. Footwear according to claim 4, in which the functional layer has a water vapor-permeable membrane.

11. Footwear according to claim 4, in which the functional layer has a membrane constructed with expanded microporous polytetrafluoroethylene (ePTFE).

12. Footwear according to claim 6, in which the air-permeable layer is situated beneath the shaft bottom functional layer.

13. Footwear according to claim 7, in which the air-permeable layer is situated directly beneath the shaft bottom functional layer.

14. Footwear according to claim 4, in which the air-permeable layer is embodied as at least water vapor-permeable in the direction toward functional layer.

* * * * *